US005583620A

United States Patent [19]

Miyamoto

[11] Patent Number: 5,583,620

[45] Date of Patent: Dec. 10, 1996

[54] IMAGE FORMING APPARATUS HAVING SCANNER DRIVEN BY PULSE MOTOR

[75] Inventor: Kazuki Miyamoto, Yokohama, Japan

[73] Assignee: Canon Kabushiki Kaisha, Tokyo, Japan

[21] Appl. No.: 376,094

[22] Filed: Jan. 20, 1995

Related U.S. Application Data

[63] Continuation of Ser. No. 137,506, Oct. 18, 1993, abandoned, which is a continuation of Ser. No. 921,402, Jul. 30, 1992, abandoned, which is a continuation of Ser. No. 673,201, Mar. 21, 1991, abandoned.

[30] Foreign Application Priority Data

| | | | |
|---|---|---|---|
| Mar. 23, 1990 | [JP] | Japan | 2-072117 |
| Apr. 25, 1990 | [JP] | Japan | 2-107491 |
| Jun. 15, 1990 | [JP] | Japan | 2-155255 |

[51] Int. Cl.[6] ..... G03G 15/28

[52] U.S. Cl. ..... 355/235; 318/685; 318/696

[58] Field of Search ..... 355/55, 56, 58, 355/233, 235, 243; 358/410, 412, 413; 318/138, 254, 439, 685, 696, 779; 388/811, 815, 915

[56] References Cited

U.S. PATENT DOCUMENTS

| | | | |
|---|---|---|---|
| 4,333,042 | 6/1982 | Kawada et al. | 318/811 |
| 4,471,282 | 9/1984 | Moriguchi | 318/696 |
| 4,476,421 | 10/1984 | Moriguchi | 318/696 |
| 4,477,756 | 10/1984 | Moriguchi | 318/696 |
| 4,490,664 | 12/1984 | Moriguchi | 318/696 |
| 4,513,898 | 4/1985 | Spitsbergen | 226/44 |
| 4,535,405 | 8/1985 | Hill et al. | 318/685 X |
| 4,540,927 | 9/1985 | Tanimoto | 318/696 |
| 4,555,653 | 11/1985 | Nawada et al. | 318/696 |
| 4,642,544 | 2/1987 | Furamura et al. | 318/696 |
| 4,906,910 | 3/1990 | Tanuma et al. | 318/696 |
| 4,917,460 | 4/1990 | Yamada et al. | 355/56 X |
| 5,059,883 | 10/1991 | Takahashi | 318/696 |
| 5,157,515 | 10/1992 | Hasegawa | 358/412 |

FOREIGN PATENT DOCUMENTS 0218396 8/1989 Japan .

*Primary Examiner*—Robert Beatty

*Attorney, Agent, or Firm*—Fitzpatrick, Cella, Harper & Scinto

[57] ABSTRACT

An image forming apparatus includes a load for scanning an original document, a pulse motor for driving the load and a supplying unit for supplying a simulated sine waveform driving signal to the pulse motor. A one/two-phase excitation method is used when the load is moved forward and a two-phase excitation method is used when the load is moved backward. The load is moved at a speed corresponding to an image forming magnification. The number of steps per period of the simulated sine waveform driving signal will be changed depending on the excitation method of the pulse motor or the magnification.

22 Claims, 20 Drawing Sheets

| FIG. 3A-1 | FIG. 3A-2 |
|---|---|

IMAGE FORMING APPARATUS HAVING SCANNER DRIVEN BY PULSE MOTOR

This application is a continuation of application Ser. No. 08/137,506, filed Oct. 18, 1993, which is a continuation of application Ser. No. 07/921,402, filed Jul. 30, 1992, which in turn is a continuation of application Ser. No. 07/673,201, filed Mar. 21, 1991, all now abandoned.

BACKGROUND OF THE INVENTION

1. Field of the Invention

The present invention relates to an image forming apparatus for driving a load for reading or recording an image by a pulse motor.

2. Related Background Art

Conventionally, an image forming apparatus which adopts a pulse motor as a driving source for driving a load for reading an image has been put into practical applications. An apparatus of this type drives a pulse motor by, e.g., a constant current chopper method.

However, when a pulse motor is driven by the constant current chopper method, a current flowing through the motor abruptly rises. For this reason, the motor generates noise signals, and as a result, noise level cannot be lowered. Such noise results in blurring of an image to be formed.

SUMMARY OF THE INVENTION

It is an object of the present invention to improve an image forming apparatus using a pulse motor.

It is another object of the present invention to eliminate noise of an image forming apparatus.

It is still another object of the present invention to improve image quality.

It is still another object of the present invention to prevent shortage of a torque of a pulse motor used in image formation.

BRIEF DESCRIPTION OF THE DRAWINGS

FIG. 3I is a block diagram for explaining principal part of the micro-step control unit;

DETAILED DESCRIPTION OF THE PREFERRED EMBODIMENTS

First Embodiment

Figure 1:
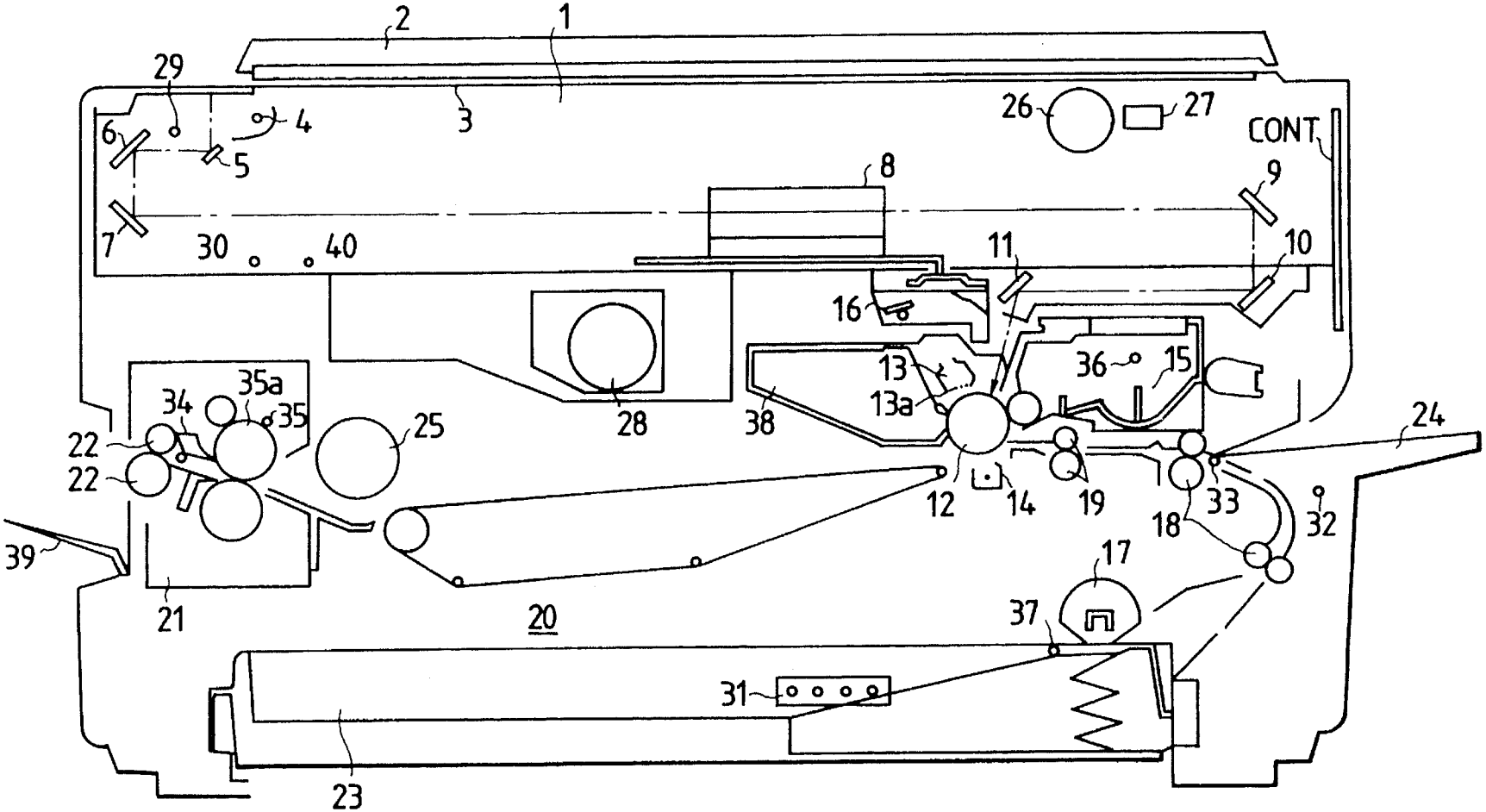
FIG. 1 is a sectional view for explaining an arrangement of an image forming apparatus according to an embodiment of the present invention.

FIG. 1 is a sectional view for explaining an arrangement of an image forming apparatus according to the first embodiment of the present invention.

Figures 1, 3A:
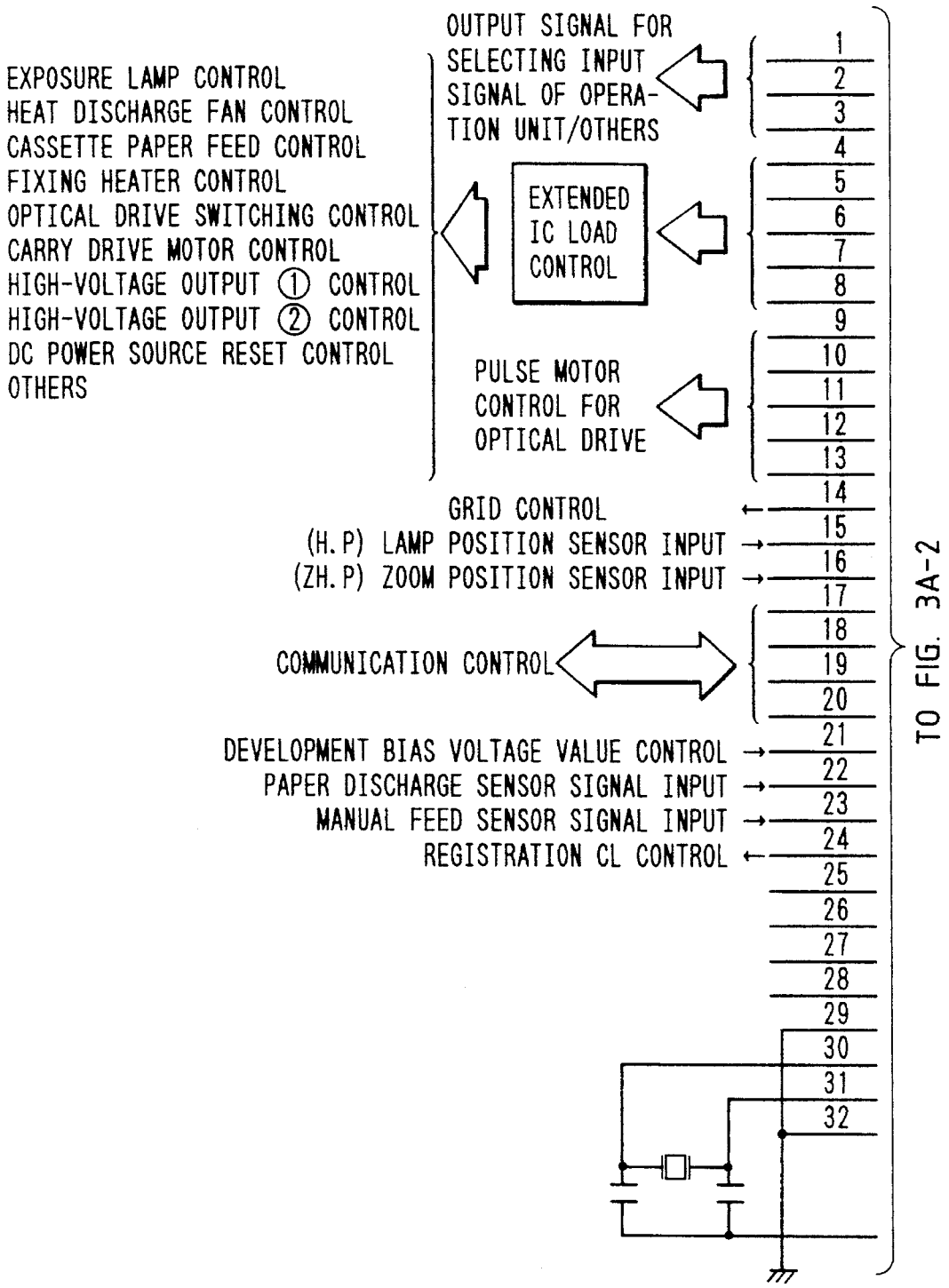
FIG. 3A is a block diagram for explaining an arrangement of a one-chip microcomputer shown in FIG. 1.
Figures 2, 3A:
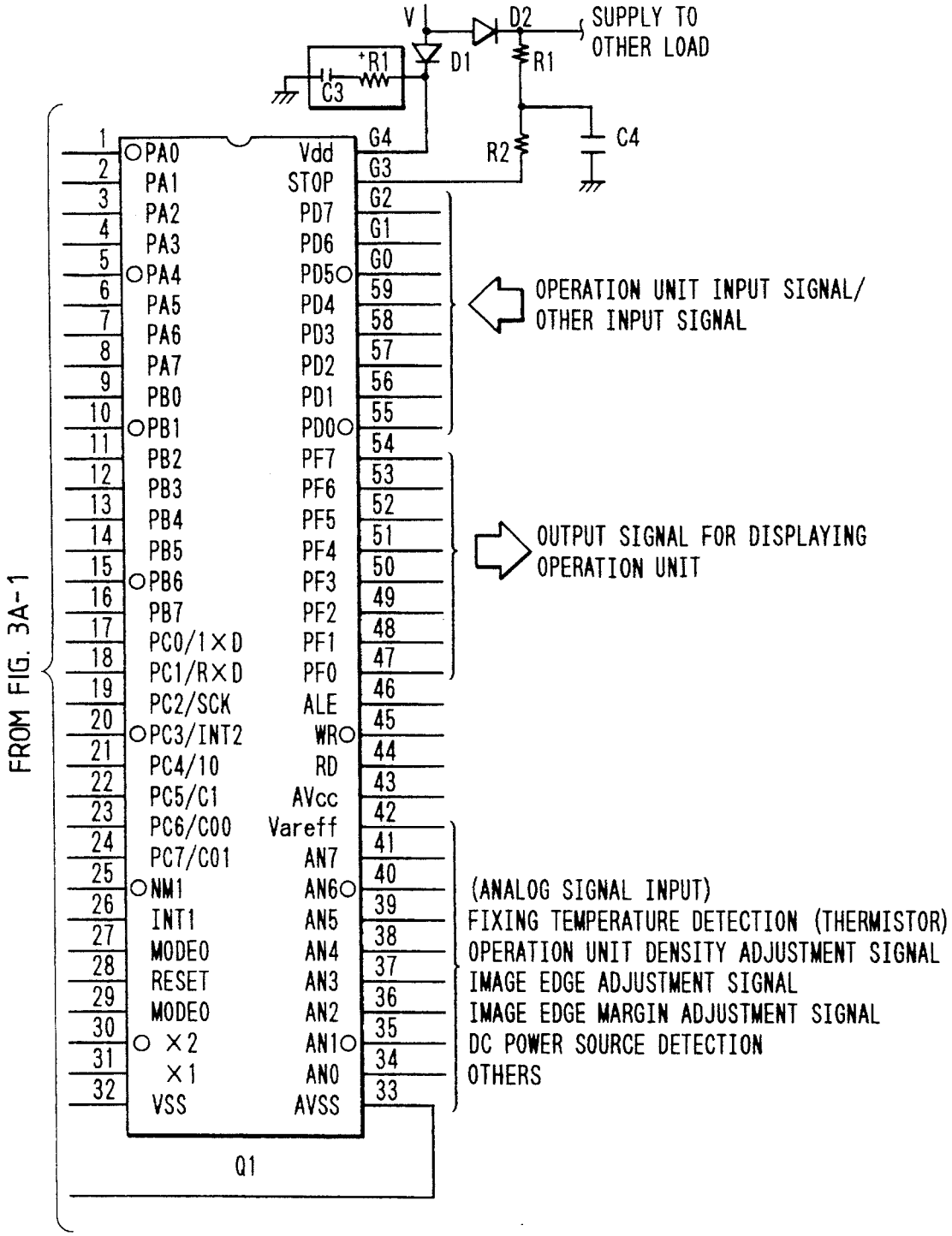
Figure 3B:
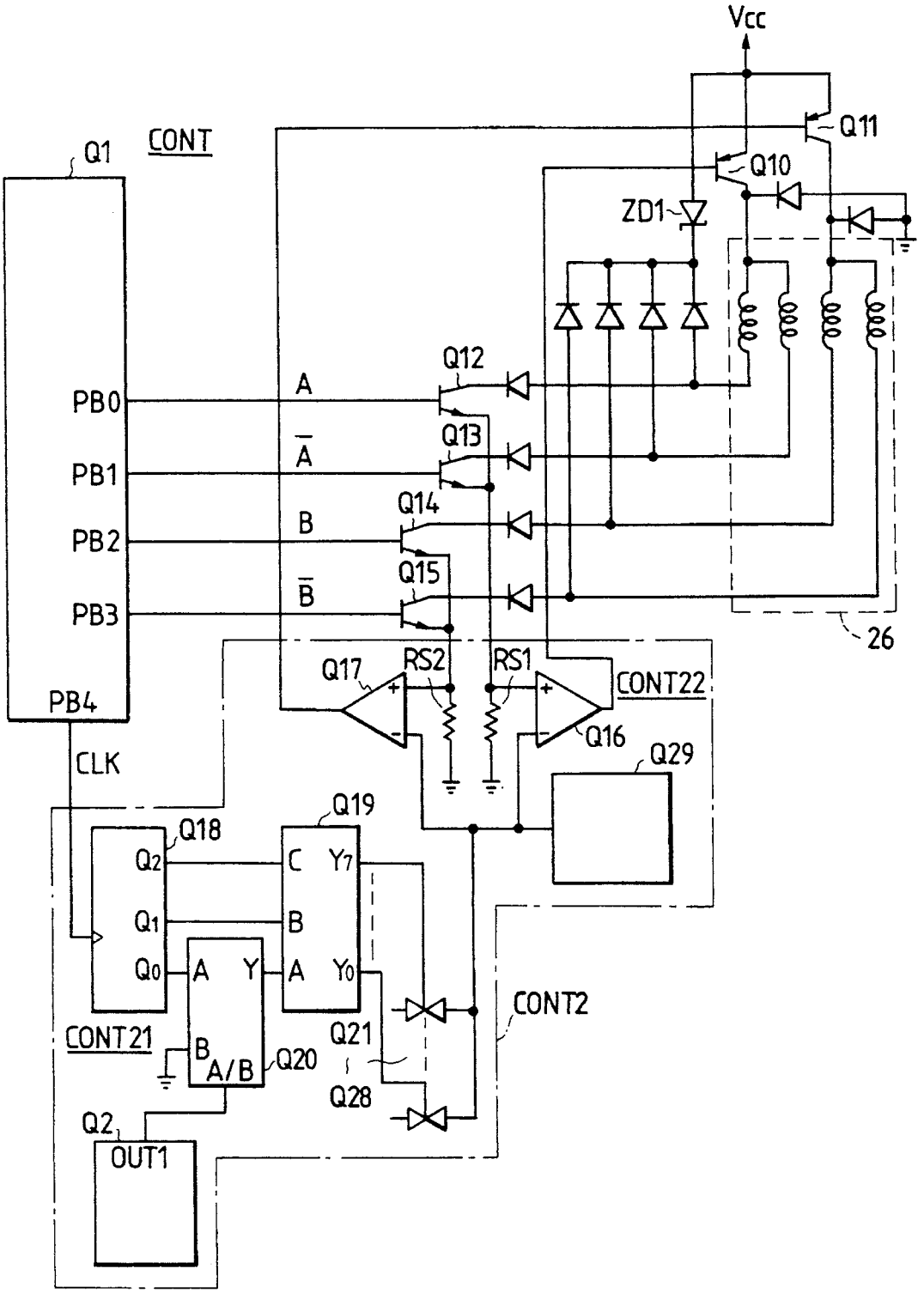
FIG. 3B is a block diagram for explaining an arrangement of a micro-step control unit.

In FIG. 1, a driving system is separated into a main driving system for driving a paper feed unit, a convey unit, a photosensitive body, and a fixing unit, and an optical driving system for driving an optical system. The main driving system employs an AC sync motor 25, and the optical driving system employs a pulse motor (stepping motor) 26; A controller CONT comprises a one-chip microcomputer Q1, a micro-step control unit CONT2, and the like, as shown in FIGS. 3A and 3B (to be described later).

Note that the micro-step control unit CONT2 comprises a resolution setting unit CONT21, and a current value setting unit CONT22. When speed data of a load is set, the control unit CONT2 controls a driving operation of the pulse motor on the basis of the set speed data.

The resolution setting unit CONT21 varies a resolution on the basis of the set speed data.

The current value setting unit CONT22 varies a micro-step constant current to be applied to the pulse motor 26 on the basis of the set speed data.

As a paper feed method, a paper feed mode from a cassette 23, and a paper feed mode from a manual insertion unit 24 can be selected. In the paper feed mode from the cassette 23, a switch for detecting the presence/absence of the cassette 23, switches 31 for detecting the size of the cassette, and a switch 37 for detecting the presence/absence of paper sheets in the cassette 23 monitor a paper feed state. When the switches detect an abnormality, the abnormality is displayed on a display unit (to be described later).

In the manual insertion mode, a paper feed state is monitored by a switch 32 for detecting a state of the manual insertion unit 24. When the switch 32 detects an abnormality, the abnormality is displayed on the display unit (to be described later).

A photosensitive body 12 is rotated clockwise in FIG. 1. A potential charged on the photosensitive body 12 by a primary charger 13 is exposed at an exposure position, and the exposed portion is developed by a developing unit 15 to form a toner image. The toner image is transferred onto a transfer sheet fed from the paper feed unit by a transfer unit 14. A residual toner is removed from the photosensitive body 12 by a cleaning unit 38 after the transfer operation. In addition, a residual potential is discharged from the photosensitive body 12 by a pre-exposure lamp 16. Thereafter, the same image formation process is repeated. The transfer sheet on which the image is transferred is conveyed to a fixing unit 21 by a conveyor belt of a convey unit 20. The fixing unit 21 comprises a heat roller 35*a* on a surface of which a temperature sensor (thermistor) 35 is arranged, and a roller which is urged against the heat roller 35*a*, and whose surface has elasticity. The heat roller 35*a* employs a halogen lamp as a heat source. The halogen lamp is incorporated in the roller 35*a* to extend in a direction of a roller shaft of the roller 35*a*. The halogen lamp is controlled by the thermistor 35, so that the surface temperature of the heat roller 35*a* is kept at a predetermined temperature.

The sheet passing through the fixing unit 21 is exhausted from the fixing unit 21 by exhaust rollers 22, and is stacked on an exhaust tray 39.

An exhaust sensor 34 detects whether or not a transfer sheet normally passes through the fixing unit 21.

Figure 5:
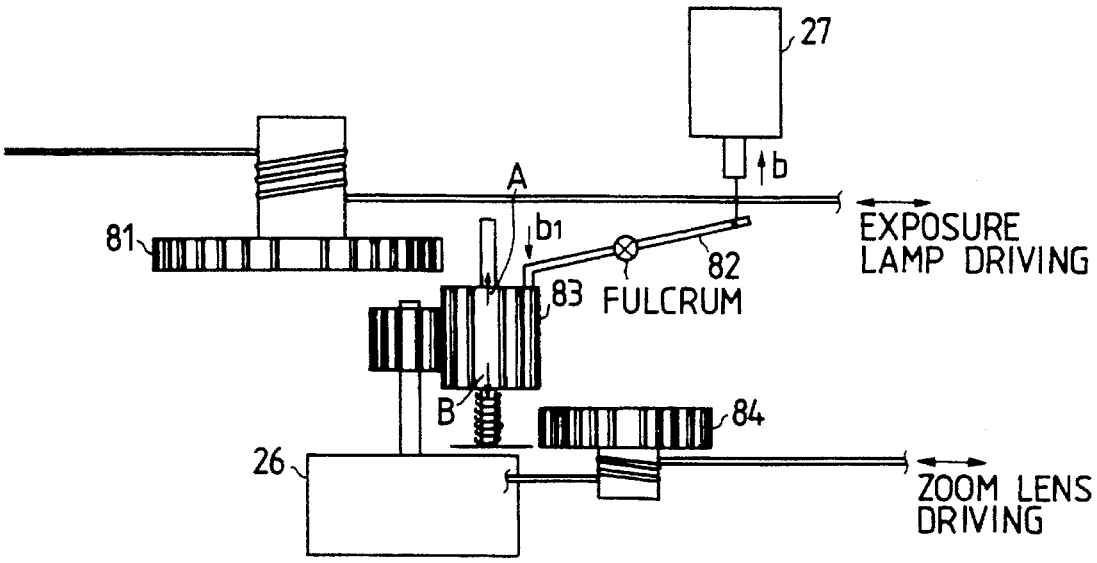
FIG. 5 is a plan view for explaining a driving mechanism of an optical scanning system shown in FIG. 1.

The optical driving system employs the pulse motor 26 as its driving source, as described above. As will be described in detail later with reference to FIG. 5, the driving source, i.e., the pulse motor 26 drives quite different loads upon operation of a drive switching solenoid 27.

One load includes an exposure lamp 4, and a unit constituting a first mirror 5, a second mirror 6, and a third mirror 7, and the other load is a unit constituting a zoom lens 8. These loads which do not require synchronized driving operations can be driven by a common driving source. Note that an original scanning unit 1 scans an original placed on an original glass 3 and pressed by an original pressing plate 2.

The apparatus of this embodiment has a multiple magnification selection function under the position control of the zoom lens 8, and under the speed control of the lamp system components 4 to 7 by the pulse motor 26, a function of automatically selecting a density by a photosensor 40 for detecting light reflected by an original placed on the surface of the original glass 3, an automatic copying magnification selection function on the basis of a communication with an external apparatus (not shown), a memory back-up function of storing various states when an abnormality such as paper jam occurs, e.g., a remaining copy count, a magnification value, abnormality data, and the like, a page continuous copying function realized by controlling the position of the exposure lamp 4 by the pulse motor 26, a function of switching control based on a state of a switch 36 for detecting exchange of the developing unit 15 since the developing unit 15 can be replaced to allow formation of a multi-color image, and the like.

A power cord (not shown) of the apparatus of this embodiment is connected to a predetermined power source.

Figure 2:
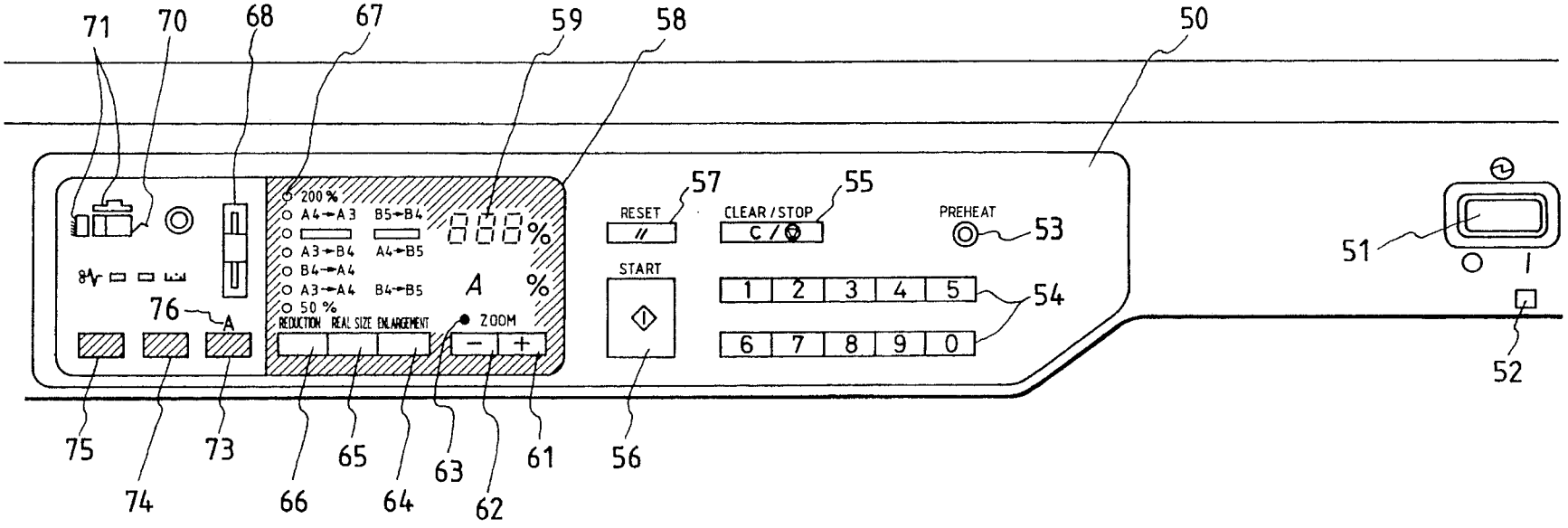
FIG. 2 is a plan view for explaining an operation panel adopted in an image forming apparatus main body shown in FIG. 1.

FIG. 2 is a plan view for explaining an operation panel 50 applied to the image forming apparatus main body shown in FIG. 1. The operation panel is arranged on the upper surface of the apparatus main body shown in FIG. 1. When an I-side portion of a power switch 51 is depressed, the apparatus is powered, and at the same time, a power indication lamp 52 is turned on. The operation panel 50 includes a preheat key 53, a clear/stop key 55, a 7-segment display 59, a density setting key 68, jam indicators 70 and 71, and indicators 73 to 75.

In an initial state after power-on, the thermistor 35 of the fixing unit 21 detects that the temperature of the heat roller 35*a* has not reached a predetermined temperature, and controls to turn on a fixing heater (not shown). When the power switch is turned on, indications on the operation panel are set in a standard mode as follows. The count display 59 displays "1", a magnification indicator 67 indicates a real size (equal size) magnification, and "A" of an automatic density adjustment indicator 76 is illuminated.

An indicator incorporated in a copy start key 56 is turned on in red when the temperature of the fixing unit 21 has not reached a fixing temperature. When the temperature reaches the fixing temperature, the indication color of the indicator turns green, thus indicating that a copying operation can be performed. Normally, other indicators are kept off.

The fixing temperature of the fixing unit 21 varies depending of the type of the developing unit 15, and a set temperature is switched by discriminating the type of the developing unit 15 by the switch 36 arranged in the developing unit 15. When a temperature must be decreased, the interior of the apparatus is forcibly cooled by a cooling fan 28, so that the fixing temperature can be reached early.

FIG. 3B is a block diagram for explaining an arrangement of the micro-step control unit CONT2, and the same reference numerals in FIG. 3B denote the same parts as in FIG. 1.

In FIG. 3B, transistors Q10 and Q11 respectively chop A and B phases of the pulse motor 26. Transistors Q12 to Q15 switch phases of the pulse motor 26 in accordance with phase switching signals PB0 to PB3. Resistors RS1 and RS2 detect current values of the pulse motor 26, and input the detected current values to comparators Q16 and Q17. The comparators Q16 and Q17 compare currents flowing through the pulse motor 26 with a reference voltage (one voltage is selected via analog switches Q21 to Q28), so that constant currents flow through the A and B phases of the pulse motor 26.

A 3-bit counter Q18 generates a current switching signal on the basis of a clock CLK supplied from a port PB4 of a one-chip microcomputer Q1, and frequency-divides the clock to generate a phase switching signal. A decoder Q19 decodes an output from the 3-bit counter Q18. A selector Q20 switches a micro-step resolution on the basis of a switching control signal output from an output terminal OUT1 of an extended IC Q2. The extended IC Q2 outputs a switching control signal in accordance with a speed of the pulse motor 26. The decoder Q19 sets one of decoder outputs $Y_0$ to $Y_7$ at "H" level to supply one of reference voltages Vref0 to Vref7 to the comparators Q16 and Q17. A trigger pulse oscillation circuit Q29 generates a triangular wave superposed on a reference voltage to attain a constant current driving operation.

Figure 3C:
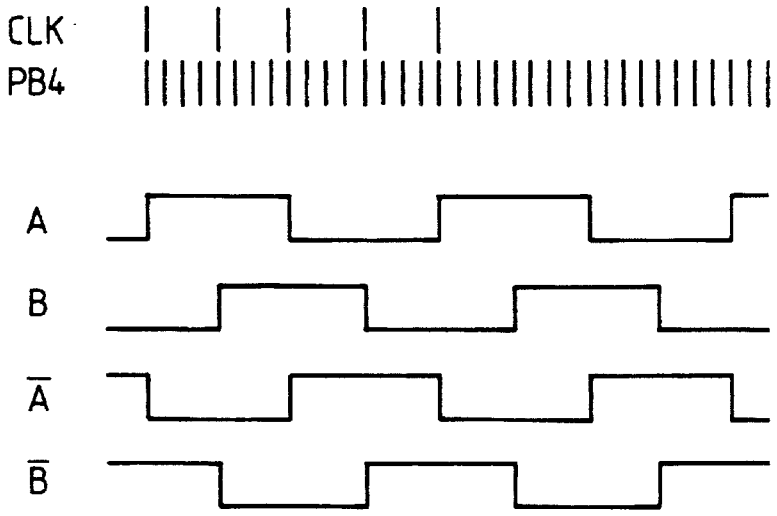
FIG. 3C is a phase excitation timing chart of a pulse motor shown in FIG. 3B.

FIG. 3C is a phase excitation timing chart of the pulse motor 26 shown in FIG. 3B.

Figure 3D:
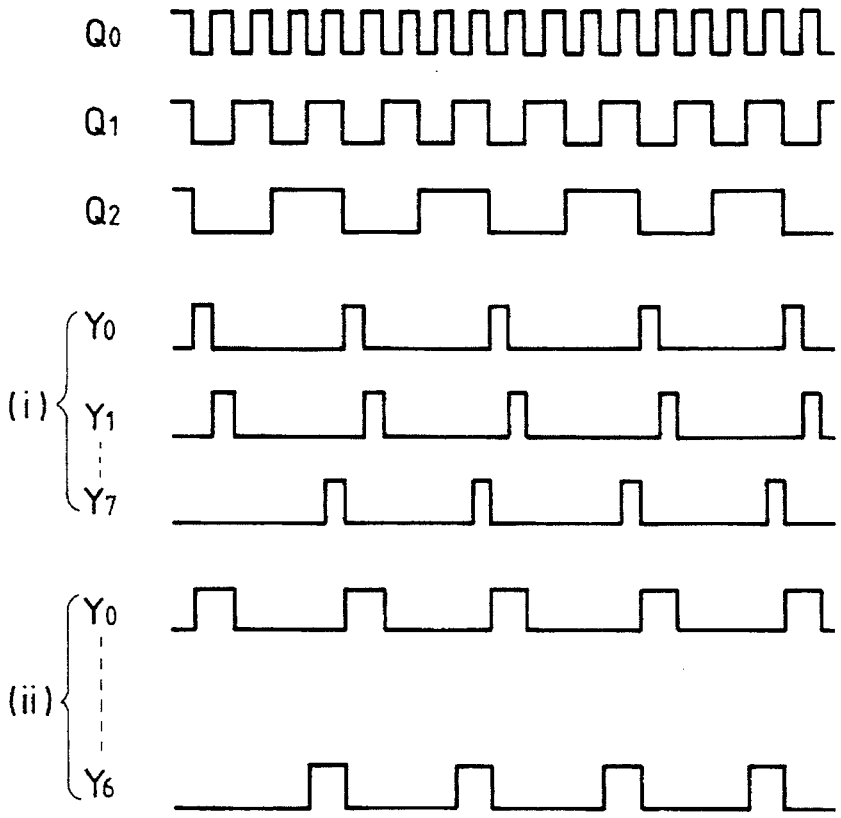
FIG. 3D is a timing chart for explaining an operation of a micro-step driving unit shown in FIG. 3B.

FIG. 3D is a timing chart for explaining the operation of the micro-step control unit CONT2 shown in FIG. 3B. Note that outputs $Y_0, Y_1, \ldots, Y_7$ from the decoder Q19 correspond to decoder outputs in a micro-step mode, and outputs $Y_0, Y_2, \ldots, Y_6$ from the decoder Q19 correspond to decoder outputs in a coarse step mode. The above description corresponds to processing by the resolution setting unit CONT21.

The micro-step driving processing operation in the image forming apparatus of this embodiment will be described below with reference to the flow charts shown in FIGS. 3E and 3F.

Figure 3E:
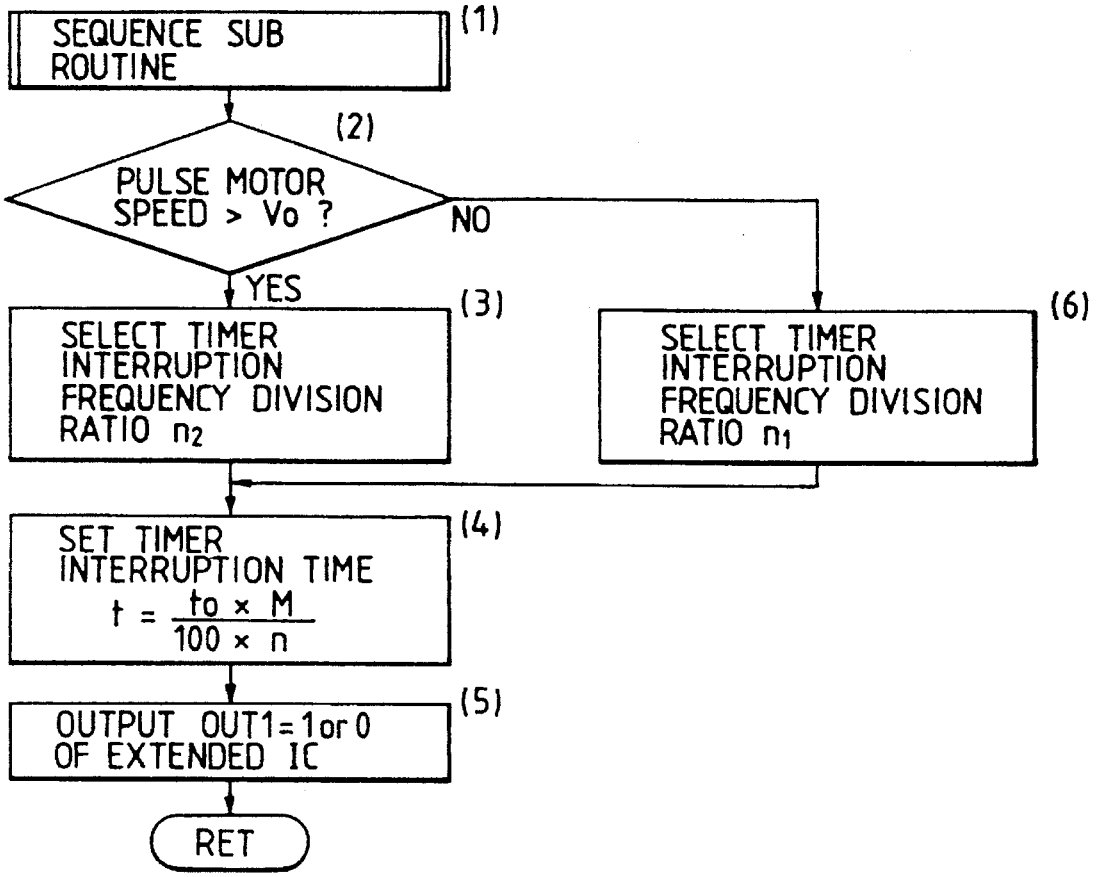
FIGS. 3E and 3F are flow charts for explaining a micro-step driving processing sequence in the image forming apparatus according to the present invention.
Figure 3F:
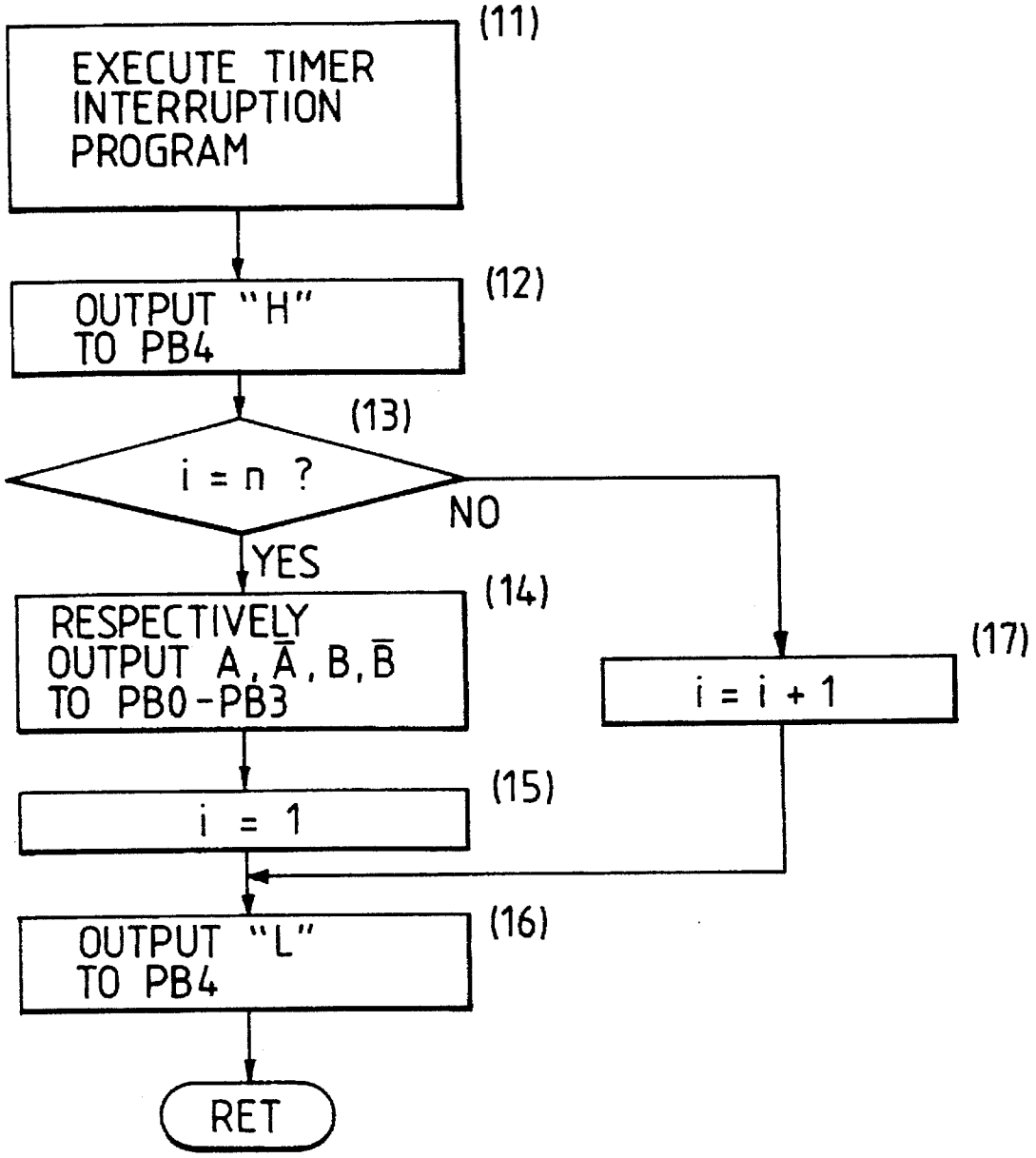

FIGS. 3E and 3F are flow charts for explaining the micro-step driving processing sequence in the image forming apparatus of this embodiment. Note that (1) to (6), and (11) to (17) in these charts designate steps.

When a copying magnification M is input from the operation panel shown in FIG. 2, a sequence sub routine of the main program is executed (step (1)) to calculate a set speed of the pulse motor 26 in the sequence sub routine, and it is checked if the set speed is higher than a predetermined value $v_0$ (step (2)). If NO in step (2), a timer interruption frequency division ratio $n_1$ is selected (step (6)) and a timer interruption time t is calculated based on the following equation (1) (step (4)):

$$t = \frac{t_0 \times \text{Magnification } M}{100 \times n} \quad (1)$$

where n is the timer interruption frequency division ratio (selected one of $n_1$ and $n_2$), and $t_0$ is the interruption time in a real-size mode.

If YES in step (2), the timer interruption frequency division ratio $n_2$ is selected (step (3)), and the timer interruption time t is calculated based on equation (1) (step (4)).

The output terminal OUT1 of the extended IC Q2 is set to be "0" (in only micro-step processing) (step (5)), and the flow returns to the main program.

When the timer interruption time t calculated in step (4) is reached, the flow chart shown in FIG. 3F is started, thus initiating the timer interruption program (step (11)).

The one-chip microcomputer Q1 sets a port PB4 at "H" level (step (12)). It is then checked if a count value i is equal to n (step (13)). If YES in step (13), the microcomputer Q1 Outputs phase switching signals PB0 to PB3 (step (14)), and resets the count value i to be "1" (step (15)).

The microcomputer Q1 then sets the port PB4 at "L" level (step (16)), thereby ending processing.

If NO in step (13), the count value i is counted up by "1" (step (17)), and the flow returns to step (16).

In this manner, every time a timer interruption is started, the output PB4 is set at "H" or "L" level, thus generating the clock CLK.

The clock CLK is input to a clock input terminal of the 3-bit counter Q18. Outputs $Q_0$ to $Q_2$ of the 3-bit counter Q18 are input to the decoder Q19 at timings shown in FIG. 3D. Furthermore, the decoder Q19 outputs decoder outputs $Y_0$ to $Y_7$ at timings shown in FIG. 3D.

The outputs $Y_0$ to $Y_7$ from the decoder Q19 are respectively supplied to the analog switches Q21 to Q28. When the decoder output $Y_0$ is at "H" level, the analog switch Q21 is activated, and the reference voltage Vref0 is input to the inverting input terminals of the comparators Q16 and Q17, thereby selecting one micro-step constant current value $I_0$.

Note that the constant current value $I_n$ is calculated by the following equation (2):

$$I_n = \frac{Vrefn}{Rsm} \quad (2)$$

In this embodiment, n is a value between 0 to 7, and m is 1 or 2.

When a timer interruption is started, the clock CLK is generated, and the count value of the 3-bit counter Q18 is incremented by one. The decoder Q19 selects the next decoder output $Y_1$. Thus, the reference voltage Vref1 is applied to the inverting input terminals of the comparators Q16 and Q17, and one micro-step constant current value $I_1$ is selected.

Figure 3G:
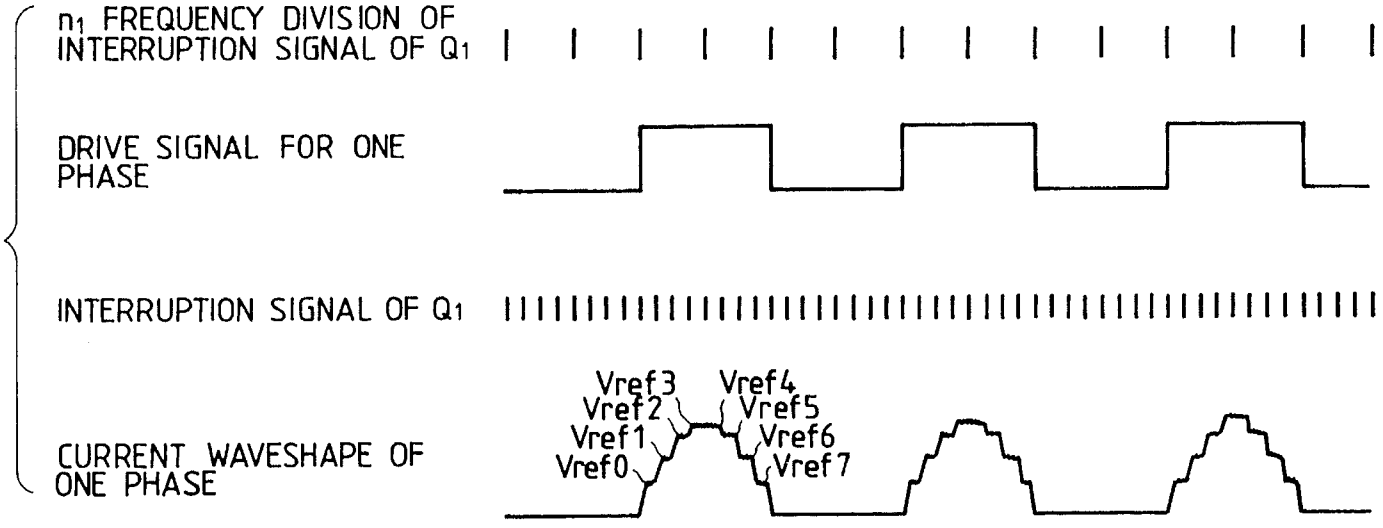
FIGS. 3G and 3H are charts for explaining the operation of FIG. 3B.

When the above-mentioned processing is repeated, a current waveform WA of a given phase of the pulse motor 26 is changed, as shown in FIG. 3G. Note that the current waveform WA is preferably closer to a sine waveform as much as possible.

On the other hand, coarse micro-step processing corresponds to a case wherein the speed of the pulse motor 26 exceeds the predetermined value $v_0$ in the flow chart shown in FIG. 3E. When the speed of the pulse motor 26 exceeds the predetermined value $v_0$, the timer interruption frequency division ratio $n_2$ is selected, and the output terminal OUT1 of the extended IC Q2 is set at "H" level. When a timer interruption occurs, as described above, the port PB4 of the one-chip microcomputer Q1 outputs the clock CLK. Since the B side (FIG. 3B) of the selector Q20 is selected by the output terminal OUT1 of the extended IC Q2, the A input of the decoder Q19 is fixed at "0". More specifically, of the decoder outputs $Y_0$ to $Y_7$ shown in FIG. 3D, the decoder outputs $Y_0, Y_2, \ldots, Y_6$ are selected (for two periods of the clock CLK), and the decoder outputs $Y_1, Y_3, \ldots, Y_7$ are not selected.

Figure 3H:
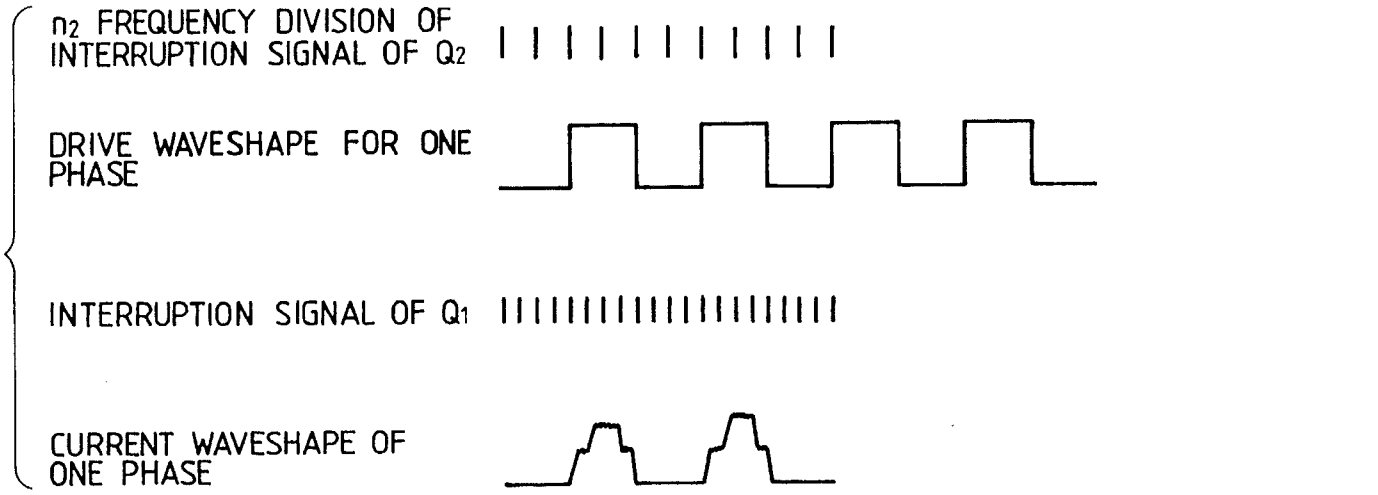
Figure 31:
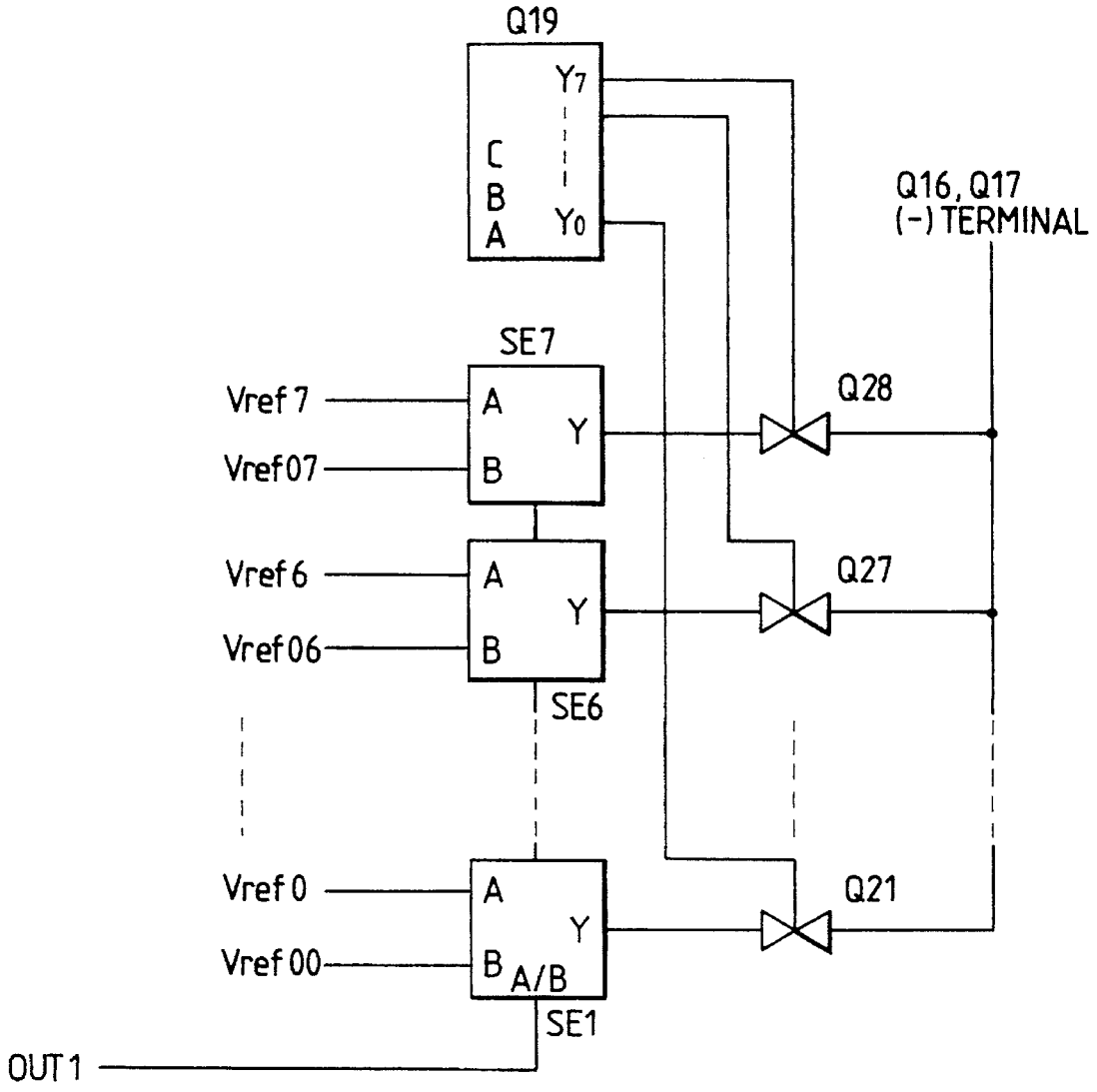

Thus, as shown in FIG. 3H, a micro-step resolution is switched from eight steps (Vref0–Vref7) to four steps (Vref00–Vref06).

As shown in FIG. 3I, when the speed of the pulse motor 26 is equal to or lower than the predetermined value $v_0$, the output terminal OUT1 of the extended IC Q2 is set at "L" level to select reference voltages Vref0 to Vref7 (Vref0, 1, 2, . . . 6, 7), thereby decreasing the micro-step current value.

On the contrary, when the speed of the pulse motor 26 is higher than the predetermined value $v_0$, the current value setting unit CONT22 controls the respective units, so that the output terminal OUT1 of the extended IC Q2 is set at "H" level to select reference voltages Vref00, Vref02, Vref04, Vref06, thereby increasing the micro-step current value. With this arrangement, torque shortage in high-speed drive of the pulse motor 26 can be prevented. Note that SE1 to SE7 designate selectors, and ANS7 designates an analog switch.

The operation of the optical driving system after power-on will be described below.

An exposure lamp system (constituted by the exposure lamp 4 and the mirrors 5 to 7) scans an original on the original glass 3 from the left edge to the right in FIG. 1, thus exposing an original image on the photosensitive body 12 via the first to third mirrors 5, 6, and 7, the zoom lens 8, and fourth to sixth mirrors 9 to 11. The starting point of movement is set at the left edge. This position will be referred to as a home position (H.P) hereinafter. A home position sensor 29 is arranged to detect the home position. When the home position sensor 29 does not detect the position of the exposure lamp 4 when the power switch is turned on, the control unit having the one-chip microcomputer Q1 shown in FIG. 3A controls rotation of the pulse motor 26 to move the exposure lamp unit to the home position (a known technique is employed for normal/reverse rotation control of the pulse motor). The start of the rotation control will be explained below with reference to the plan view shown in FIG. 5. When the drive switching solenoid 27 is in an OFF state (no force $b_1$), a switching gear 83 is moved in a direction A by a spring pressure. Thus, the output from the pulse motor 26 is coupled to a lamp driving gear 81 via the switching gear 83, thereby driving the exposure lamp system. When the switching gear 83 and the lamp driving gear 81 are engaged with each other, the rotational speed of the pulse motor 26 must be sufficiently lowered.

When the exposure lamp system is located at the home position, the pulse motor 26 drives the zoom lens 8. More specifically, the position of the zoom lens before power-on is unknown. As described above, a real-size magnification is selected as the standard mode when the power switch is turned on. For this reason, the zoom lens is temporarily returned to a reference position, and is then set at a predetermined position based on the reference position.

The above-mentioned reference position is a zoom lens home position (Z.HP). A zoom lens home position sensor 30 for detecting this position is arranged.

The drive switching solenoid 27 is then turned on. Thus, a plunger of the solenoid is moved in a direction b. For this reason, the switching gear 83 is moved by a force $b_1$ in a direction B against the spring force. With this movement, the switching gear 83 is disengaged from the lamp driving gear 81. When the gear 83 is further moved in the direction B, the switching gear 83 is engaged with a lens driving gear 84. Rotation control upon engagement of gears is the same as that described above.

The zoom lens 8 is subjected to position control within a range from an enlargement magnification of 200% attained when the lens position is near the zoom lens home position sensor 30 to a reduction magnification of 50% when the lens is further moved to the right to have the zoom lens home position sensor 30 as the reference position.

An operation branches as follows depending on a state of the zoom lens home position at the beginning of the zoom lens driving operation.

(1) When the position of the zoom lens 8 is detected by the zoom lens home position sensor 30, (1)-1 the zoom lens 8 is temporarily moved to the right to fall outside a detection range of the zoom lens home position sensor 30, and is then stopped;

(1)-2 the zoom lens 8 is moved to the left by a predetermined distance from a detection timing of the zoom lens home position sensor 30, and is then stopped.

When the zoom lens home position sensor 30 does not detect the position of the zoom lens 8, the operation (1)-2 is executed first.

The above-mentioned operations are necessary control operations for preventing a set position error caused by a backlash of gears.

Thereafter, the zoom lens 8 is moved to the right again, and is moved from a position falling outside a range of the zoom lens home position sensor 30 to a predetermined position, i.e., a position corresponding to a real-size magnification. Thereafter, the drive switching solenoid 27 is turned off. Thus, as described above, the switching gear 83 is moved in a direction to be engaged with the lamp driving gear 81. However, in order to allow smooth engagement, the switching gear 83 must be rotated, as described above. At this time, the exposure lamp system is located at the position of the home position sensor 29. For this reason, the pulse motor 26 is rotated in a direction to move the exposure lamp system to the right. As a result, the rotation of the pulse motor 26 is stopped when the exposure lamp system falls outside a range of the home position sensor 29 (the switching gear 83 is disengaged from the lamp driving gear 81), and is rotated in the reverse direction again, so that the exposure lamp system is stopped at a predetermined position after it is detected by the home position sensor 29.

Preparation for a copying operation of the apparatus of this embodiment is completed after the above-mentioned initial operation of the optical driving system is executed, and a temperature of the fixing unit 21 reaches the fixing temperature.

A copying operation using a paper sheet fed from the cassette 23 will be described below.

When the copy start key 56 is depressed, a copying operation is started on the basis of transfer sheet size data based on an input signal from the switches 31 for detecting a cassette size, copy count data set by a ten-key pad 54, magnification data selected by one of magnification selection keys 61 to 66, and data set by various other mode selection switches.

When the copy start key 56 is accepted, its indication color turns from green into red, and inputs at the ten-key pad 54, mode switching keys such as the magnification selection keys 61 to 66, and the like are inhibited. The AC sync motor 25 begins to be rotated, and its driving force is transmitted to paper feed rollers 18, the photosensitive body 12, the convey unit 20, the fixing unit 21, and the like. When the copy start key 56 is accepted, the fixing temperature of the fixing unit 21 is switched depending on the cassette size data.

After an elapse of 0.5 sec from the beginning of rotation of the AC sync motor 25, a paper feed solenoid (not shown) is operated, and a pickup roller 17 is rotated accordingly, thereby feeding a transfer sheet in the cassette 23 toward the paper feed rollers 18.

A transfer sheet feed amount of the pickup roller 17 is controlled based on the cassette size data. When the size of a transfer sheet is larger than a predetermined value, a feed-amount is increased. When the transfer sheet reaches the paper feed rollers 18, it is fed by the paper feed rollers 18 to registration rollers 19, and is stopped when the sheet reaches the rollers 19. A manual insertion sensor 33 arranged between the paper feed rollers 18 and the registration rollers 19 detects a feed state of the transfer sheet.

At a predetermined timing until the transfer sheet fed along a paper feed path reaches the registration rollers 19, the start of original scanning by the exposure lamp system is permitted. At this time, the exposure lamp 4 is located at a detection position of the home position sensor 29. More specifically, from the initial operation to a backward movement operation in a copying operation, the exposure lamp 4 is moved backward from a detection position of the home position sensor 29 by a distance according to a selected magnification at that time, and is stopped at that position.

The pulse motor 26 as the optical system driving source is subjected to a speeding up control in such a manner that a pulse rate is gradually increased in a direction to move the exposure lamp system forward from the beginning of original scanning until a driving pulse rate according to a selected magnification value is reached. More specifically, the moving speed of the exposure lamp system is gradually increased, and then reaches a target speed.

Figure 6:
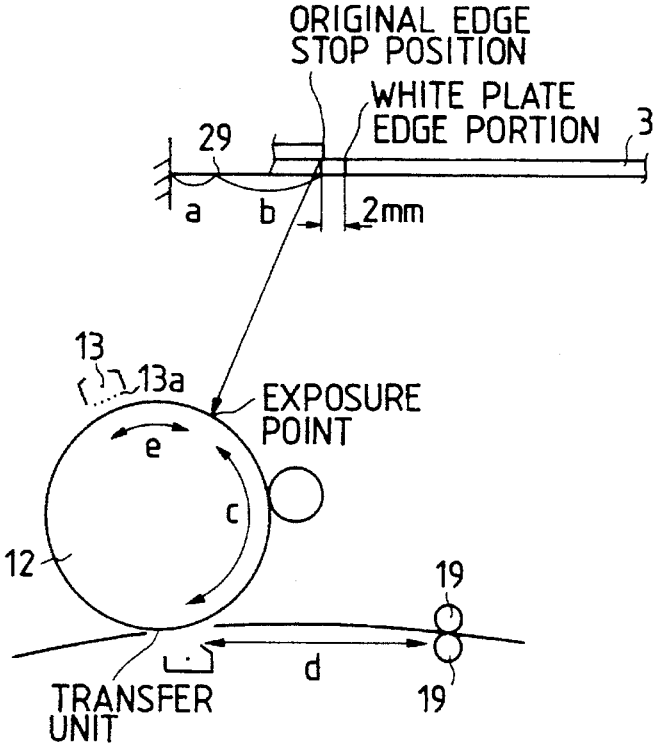
FIG. 6 is a sectional view for explaining an image formation process in the image forming apparatus according to the present invention.

A blank formation method at a leading edge portion of an image, and an image registration method with a transfer sheet will be described below with reference to FIG. 6.

In order to prevent attachment of a toner on a non-image region, a light source such as an LED lamp, a fuse lamp, or the like is normally used. In this embodiment, a voltage value of a grid **13*a* arranged in the primary charger 13 is controlled to obtain the same effect. This control is effective when it is difficult to arrange a plurality of members around a photosensitive body due to a compact apparatus. Since a distance e between an exposure point and the grid cannot be sufficiently shorter than a distance b between the home position sensor 29 and an original edge stop position, the grid 13***a* is switched from L level to a predetermined voltage after an elapse of a predetermined period of time according to a selected magnification value from the beginning of movement of the exposure lamp 4 so as to form a 2-mm blank portion from the leading edge of an original. More specifically, when the grid voltage is at L level, since no potential is charged on the photosensitive body 12, no toner image is formed, and an image can be formed from a timing at which the grid voltage is switched to the predetermined voltage. Thus, a blank portion is formed on a leading edge portion of an image.

As for registration between a transfer sheet and the leading edge of an image, a distance c between the exposure point and the transfer unit is shorter than a distance d between the registration rollers 19 and the transfer unit. For this reason, a transfer sheet waiting at the registration rollers 19 must be re-fed toward the transfer unit before an image at the leading edge of an original is actually exposed on the photosensitive drum 12.

In this embodiment, when the exposure lamp 4 begins to move and reaches its target speed, it is still detected by the home position sensor 29. A value obtained by dividing a value of the distance b+2 mm from a timing at which the exposure lamp 4 passes the home position sensor 29 at a speed according to a selected magnification corresponds to a time required until the exposure lamp 4 reaches a white plate edge portion after it passes the home position sensor 29, and this time is represented by x. A value obtained by subtracting a time required until an image at the exposure point of the photosensitive body 12 reaches the transfer unit from a time from the beginning of the re-feed operation by the registration rollers 19 until a transfer sheet reaches the transfer unit is represented by y. A time required for feeding the transfer sheet by 2 mm (2 mm÷100 mm/s=0.02 sec; convey speed=100 mm/s) is added to the value y.

The above numerical values are calculated by the following equation:

$$x-(y+0.02)=Z \text{ (sec)}$$

After an elapse of the time Z given by the above equation from when the exposure lamp 4 passes the home position sensor 29, the registration rollers 19 are operated to execute the re-feed operation, thereby obtaining a transfer sheet image formed with a 2-mm blank portion according to a selected magnification.

The exposure lamp system is moved by a predetermined scanning distance in accordance with cassette size data, magnification data, and the like, and when it reaches a target position, a pulse rate is gradually decreased (to be referred to as slowing-down control hereinafter). After the exposure lamp system is stopped, it is moved backward in a direction of the home position sensor 29 under the speeding up control and the constant speed control. When the exposure lamp system is detected by the home position sensor 29, slowing-down control for stopping the system at a position according to a selected magnification is performed, thus stopping the exposure lamp system.

A manual insertion copying operation is started upon detection of a manually inserted transfer sheet by the manual insertion sensor 33. The AC sync motor 25 starts rotation, and the paper feed rollers 18 are rotated accordingly. Thus, the inserted transfer sheet is fed toward the registration rollers 19 by the paper feed rollers 18. After an elapse of a predetermined period of time from detection of the transfer sheet by the manual insertion sensor 33, the start of original scanning of the exposure lamp system is permitted. The subsequent operations of the exposure lamp system and the transfer sheet leading edge are the same as those in the cassette feed mode, and a detailed description thereof will be omitted.

After an elapse of a time $x_1$ required for the transfer sheet to move a distance between the manual insertion sensor 33 and the transfer unit from a timing at which the trailing edge of the transfer sheet passes the manual insertion sensor 33, the operation of the registration rollers 19 is stopped. If the manual insertion sensor 33 detects the next sheet during measurement of the time $x_1$, the operation of the registration rollers 19 is stopped when a time required for the transfer sheet to pass a distance between the manual insertion sensor 33 and the registration rollers 19 elapses.

Original scanning distance control is also executed based on the trailing edge signal of the transfer sheet. The above-mentioned control operations are controlled by the one-chip microcomputer shown in FIG. 3A. The one-chip microcomputer Q1 shown in FIG. 3A is exemplified as one incorporating a ROM and a RAM.

Figure 4:
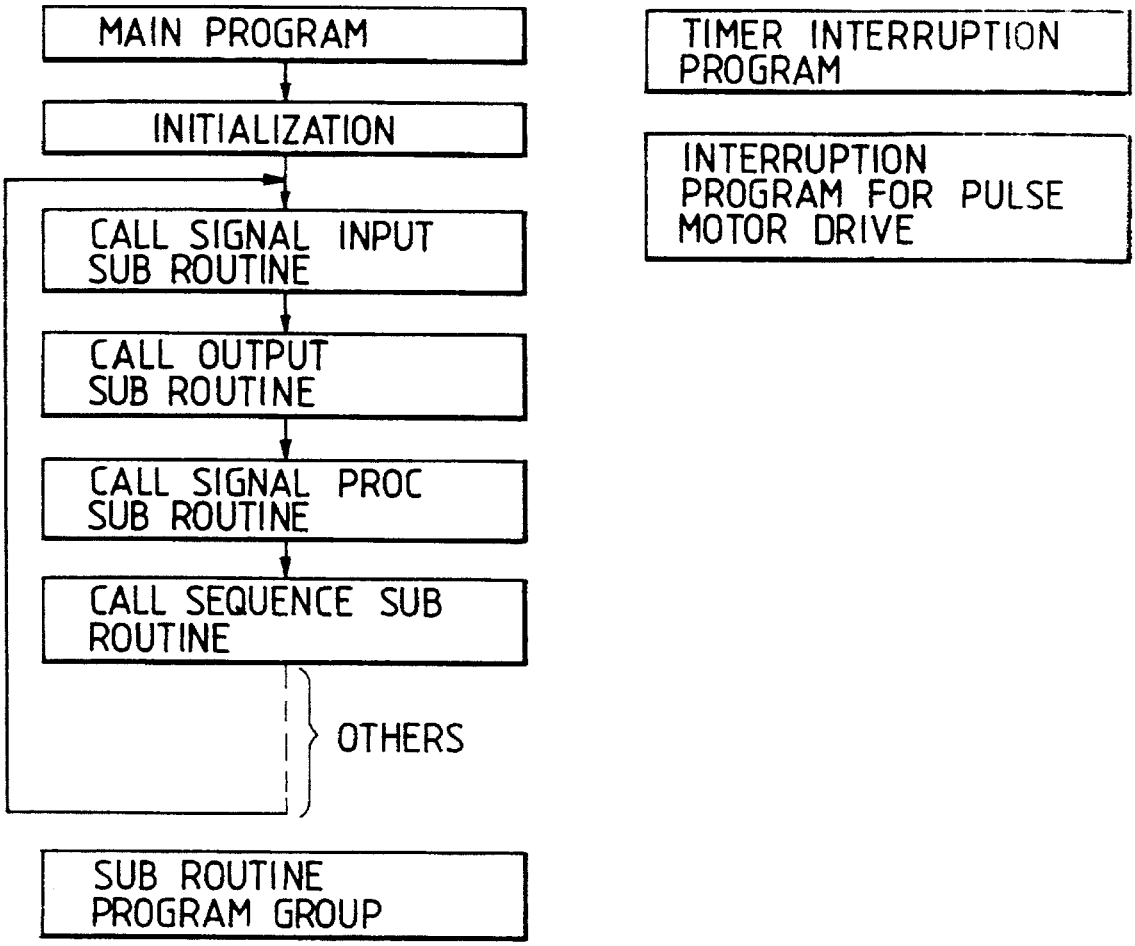
FIG. 4 is a chart for explaining a program architecture executed by the one-chip microcomputer shown in FIG. 3.

FIG. 4 is a chart for explaining a program architecture to be executed by the one-chip microcomputer Q1 shown in FIG. 3A, and a detailed description thereof will be omitted.

In the above embodiment, the pulse motor 26 is micro-step driven while assuming an optical system as a load in the image forming apparatus. However, the present invention may be applied to other loads which are moved at different speeds by utilizing the pulse motor 26, e.g., an image reader for scanning a CCD line sensor to read an original image, a printer apparatus for scanning a printer head, and the like.

Second Embodiment

During speeding up control, a pulse motor may be subjected to a constant current driving operation, or a constant speed micro-step driving operation.

Figure 7:
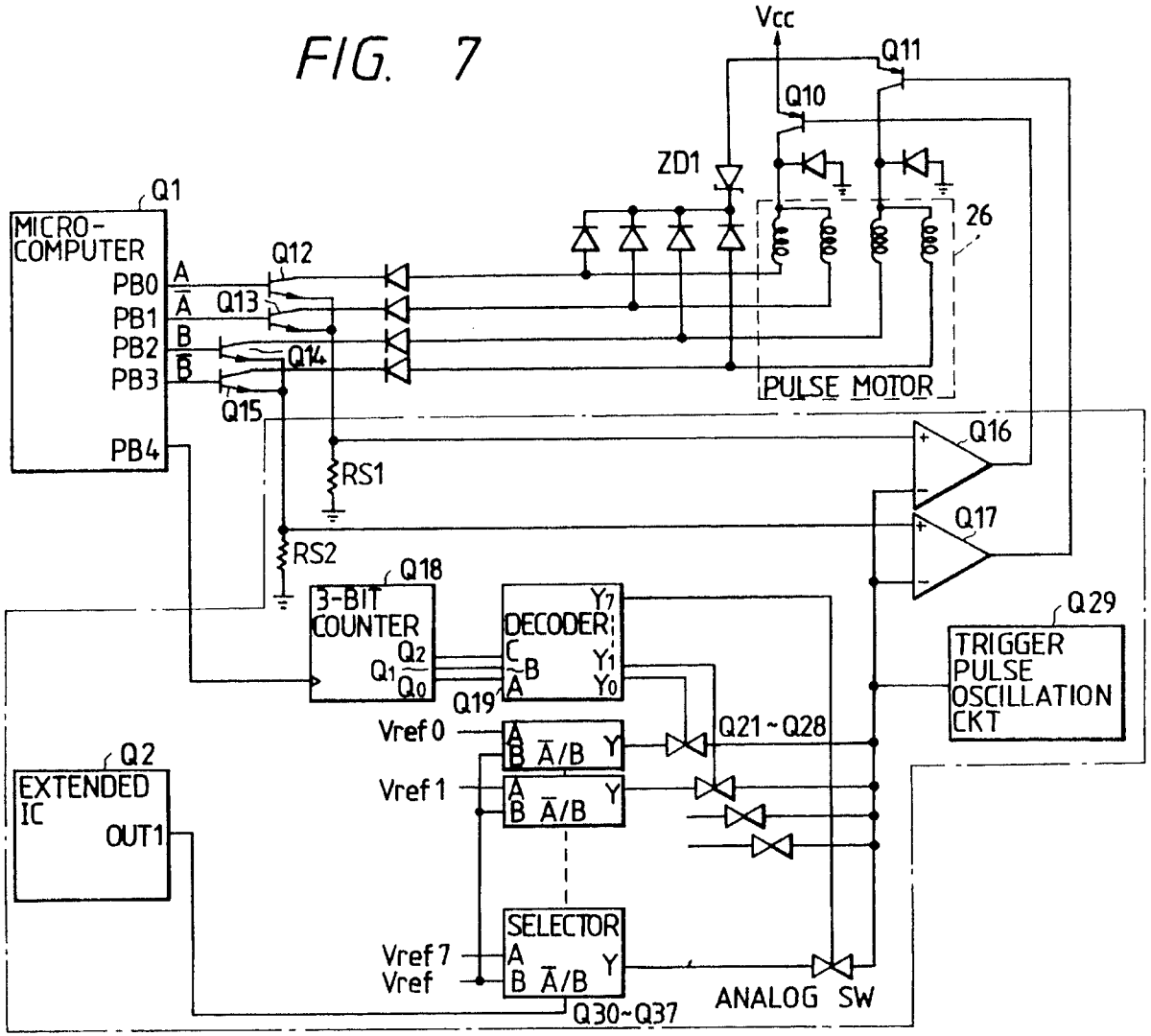
FIG. 7 is a circuit diagram showing a circuit for realizing a micro-step driving operation according to the second embodiment of the present invention.

FIG. 7 is a block diagram for explaining an arrangement of a micro-step control unit of this embodiment, and the same reference numerals in FIG. 7 denote the same parts as in FIG. 3B.

An output PB0 from a microcomputer Q1 is a phase switching signal for an A phase, an output PB1 is a phase switching signal for an $\overline{A}$ phase, an output PB2 is a phase switching signal for a B phase, and an output PB3 is a phase switching signal for a $\overline{B}$. An output out1 from an extended IC Q2 serves as a resolution switching signal for changing a micro-step resolution in speeding up or slowing-down control of a pulse motor.

Transistors Q10 and Q11 respectively chop the A and B phases. Transistors Q12 to Q15 switch phases of the pulse motor in accordance with the phase switching signals PB0 to PB3. Current detection resistors RS1 and RS2 detect current values of the pulse motor.

Comparators Q16 and Q17 compare currents flowing through the pulse motor with a reference voltage, so that constant currents flow through the A and B phases. A 3-bit counter Q18 generates a micro-step current switching signal.

A decoder Q19 decodes a counter output. Analog switches Q21 to Q28 select a reference voltage for switching a current. A circuit Q29 generates a triangular wave to be superposed on a reference voltage to attain constant current driving. Selectors Q30 to Q37 select a reference voltage for determining a constant current value.

Figure 8A:
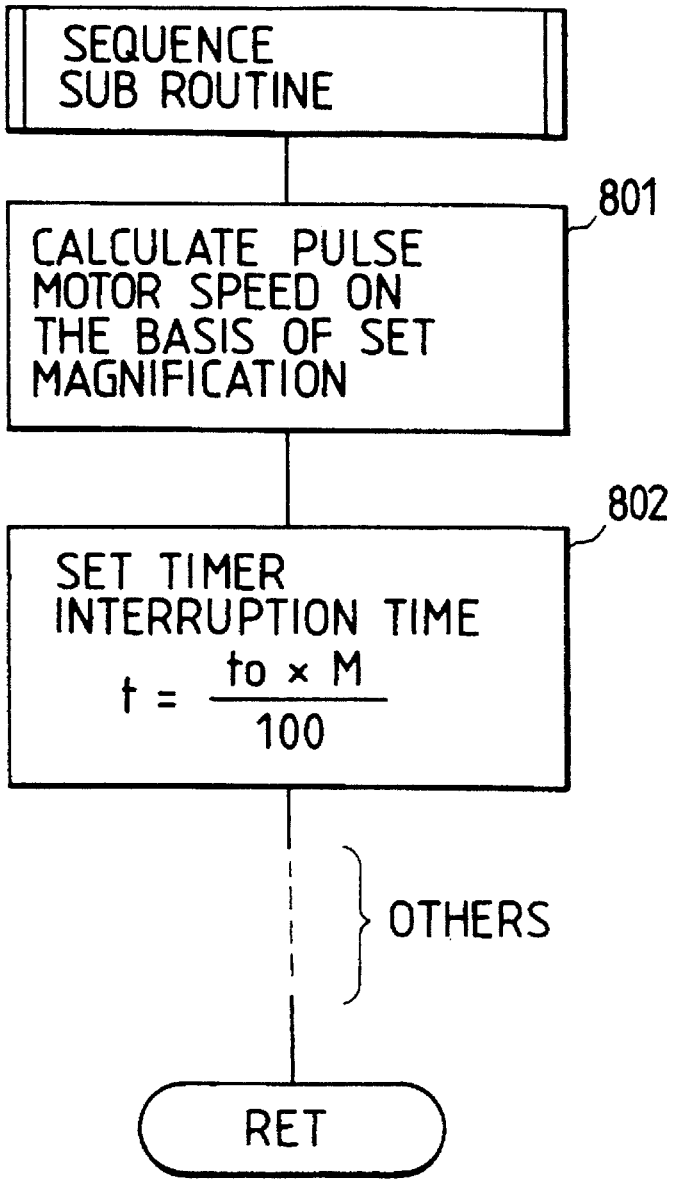
FIG. 8A is a flow chart showing a sequence sub routine of the second embodiment.

Micro-step driving will be described below with reference to FIGS. 8A and 8B.

When a copying magnification M is determined, a set speed of the pulse motor is calculated in a sequence sub routine (step 801). Then, a timer interruption time t is calculated based on the following equation (step 802).

$$t = \frac{t_0 \times \text{Magnification } M}{100}$$

$t_0$: interruption time at real-size magnification

Figure 8B:
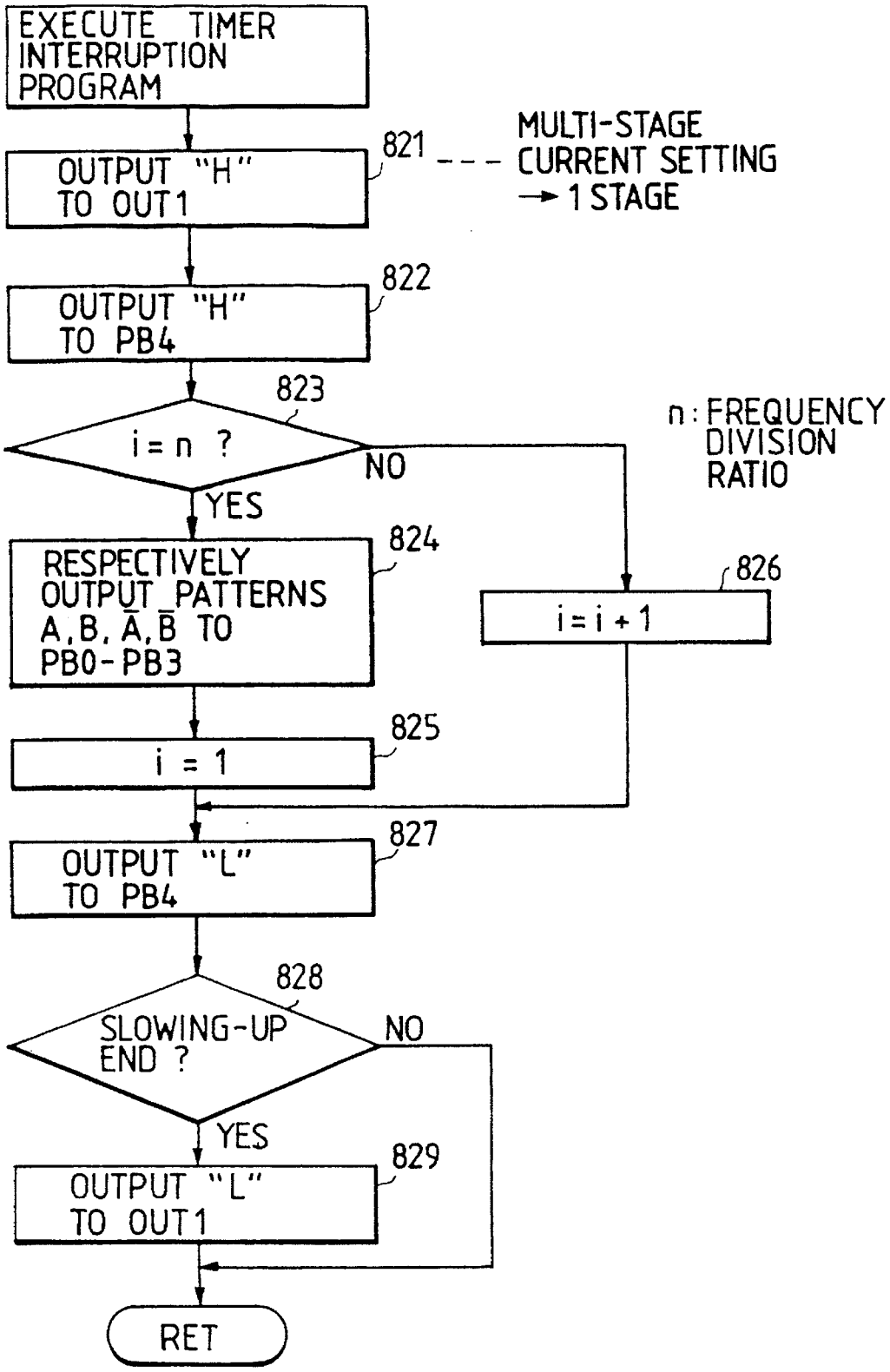
FIG. 8B is a flow chart showing a timer interruption program of the second embodiment.

In FIG. 8B, when the set timer interruption time is reached, a timer interruption program is started.

In the timer interruption program, as shown in FIG. 8B, the output out1 from the extended IC Q2 is set at "H" level to select Vref (step 821). Initially, the pulse motor is subjected to speeding up control until its speed reaches a set speed, and normal constant current driving is performed without executing micro-step driving (the number of current setting steps is set to be one). An "H"-level output is output to a port PB4 of the microcomputer Q1 (step 822), and it is then checked if a count value is equal to n (step 823).

If YES in step 823, the pulse motor phase switching signals are output to the terminals PB0 to PB3 (step 824), and i=1 is then set (step 825). If NO in step 823, i=i+1 is calculated (step 826). Furthermore, an "L"-level output is output to the port PB4 (step 827), and it is checked if speeding up control is ended (step 828). If YES in step 828, an "L"-level output is output to the output terminal out1 of the extended IC Q2 (step 829). More specifically, when the pulse motor is rotated at a constant speed, the micro-step driving is performed to minimize noise and vibration from the pulse motor. Thus, image quality can also be improved. The flow then returns to the main routine from the timer interruption program.

Every time a timer interruption occurs, "H"- and "L"-level outputs are sequentially output from the port PB4 of the microcomputer Q1, thus generating a clock CLK.

As shown in FIG. 7, the clock CLK is input to a terminal CLK of the 3-bit counter Q18, and the counter Q18 outputs counter outputs $Q_0$, $Q_1$, and $Q_2$, as shown in FIG. 3D. The counter outputs $Q_0$, $Q_1$, and $Q_2$ of the counter Q18 are input to the decoder Q19, and the decoder Q19 generates outputs $Y_0$ to $Y_7$ at timings, as shown in FIG. 3D. The decoder outputs $Y_0$ to $Y_7$ are respectively input to the analog switches Q21 to Q28. When the output $Y_0$ is at "H" level, the analog switch Q21 is activated. When the output out1 of the extended IC Q2 is at "L" level, a micro-step driving mode is set, and a voltage Vref0 is applied to (−) terminals of the comparators Q16 and Q17, thereby selecting one micro-step constant current $I_0$.

The constant current value $I_n$ is set by:

$$I_n = \frac{Vrefn}{Rsm} \quad (2)$$

for n=0, 1, . . . , 7, and m=1, 2

When the next timer interruption occurs, the clock CLK is generated, and the count value of the counter Q18 is incremented by one. The decoder Q19 sets the next output $Y_1$ at "H" level to select the voltage Vref1, thereby applying a set current $I_1$ (=Vref1/$R_s$m). When the above-mentioned operations are repeated, a current waveform shown in FIG. 3G is obtained. Note that this current waveform is preferably closer to a sine waveform as much as possible.

When the output from the output terminal out1 of the extended IC Q2 is at "H" level, that is, during speeding up or slowing-down control, not the micro-step driving mode but a constant current mode is selected. Thus, only a reference voltage Vref is selected,, regardless of patterns of the outputs $Y_0$ to $Y_7$ from the decoder Q19. Therefore, a value I of a constant current is always given by:

$$I = \frac{Vref}{Rs1}$$

In this embodiment, since a torque is required for a motor during speeding up or slowing-down control, the micro-step driving is not performed. For example, the speeding up operation may be performed under the constant current control until a motor speed reaches 80% a target speed, and when the motor speed reaches 80% the target speed, the speeding up operation may be performed under the micro-step driving control.

The micro-step driving may be started after an elapse of a predetermined period of time from when the motor speed reaches the target speed.

Third Embodiment

In this embodiment, an excitation driving method of a pulse motor 26 is switched between a two-phase excitation method and a one/two-phase excitation method depending on the speed of a load.

When the pulse motor 26 is driven by setting a plurality of steps of the constant current value to be applied to each phase of the pulse motor 26, the number of steps (resolution) of the constant current value is varied depending on the excitation driving method, and the pulse motor 26 is driven by the number of steps (resolution) best suited for the excitation driving method.

Figure 9:
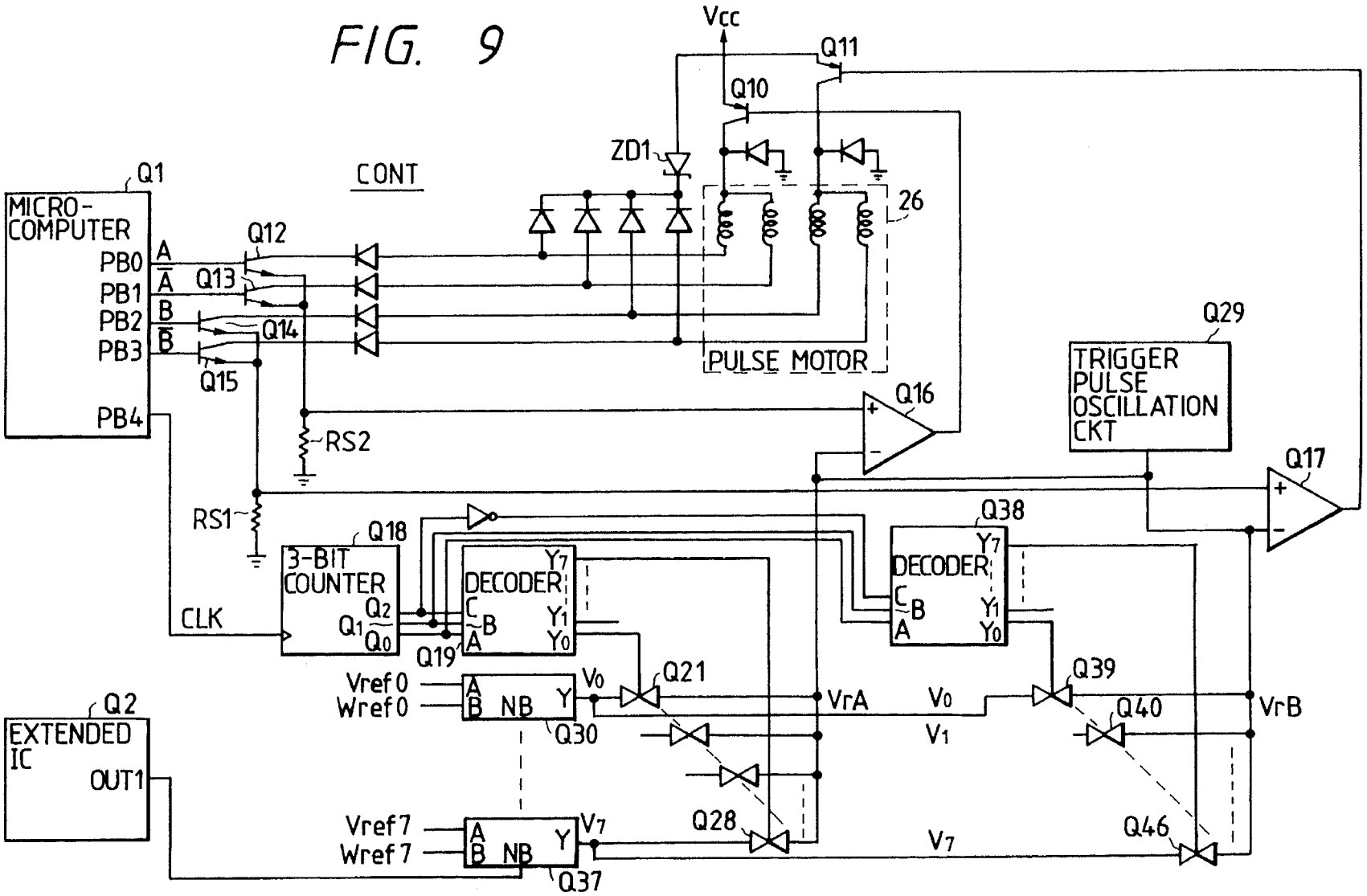
FIG. 9 is a circuit diagram for explaining an arrangement of a controller unit shown in FIG. 1.

FIG. 9 is a block diagram for explaining an arrangement of a controller unit CONT of this embodiment. The same reference numerals in FIG. 9 denote the same parts as in FIG. 3B.

In FIG. 9, transistors Q10 and Q11 respectively chop A and B phases of the pulse motor 26. Transistors Q12 to Q15 switch phases of the pulse motor 26 in accordance with phase switching signals PB0 to PB3. Resistors RS1 and RS2 detect current values of the pulse motor 26, and input the detected current values to comparators Q16 and Q17. The comparators Q16 and Q17 compare currents flowing through the pulse motor 26 with a reference voltage (one voltage is supplied via analog switches Q21 to Q28), so that constant currents flow through the A and B phases of the pulse motor 26. A 3-bit counter Q18 generates a current switching signal on the basis of a clock CLK supplied from a port PB4 of a microcomputer Q1. The clock CLK from the port PB4 of the microcomputer Q1 is generated by an internal timer of the microcomputer Q1, and a phase switching signal for the A and B phases is output in the timer interruption routine. In this embodiment, since micro-step driving is performed by the 3-bit counter Q18, the micro-step driving of $2^3$ steps can be realized.

A decoder Q19 decodes an output from the 3-bit counter Q18. Analog switches Q21 to Q28 select a reference voltage for switching a current. A trigger pulse oscillation circuit Q29 generates a triangular wave superposed on a reference voltage to attain a constant current driving operation.

A-phase selectors Q30 to Q37 select a reference voltage value for determining a set current value depending on different excitation methods. A decoder Q38 decodes an output from the counter Q18. Analog switches Q39 to Q46 select a reference voltage value for determining a set current value depending on different excitation methods.

Micro-step driving processing operations corresponding to excitation methods of the pulse motor 26 shown in FIG. 9 will be described below with reference to FIGS. 10 and 11.

Figure 10:
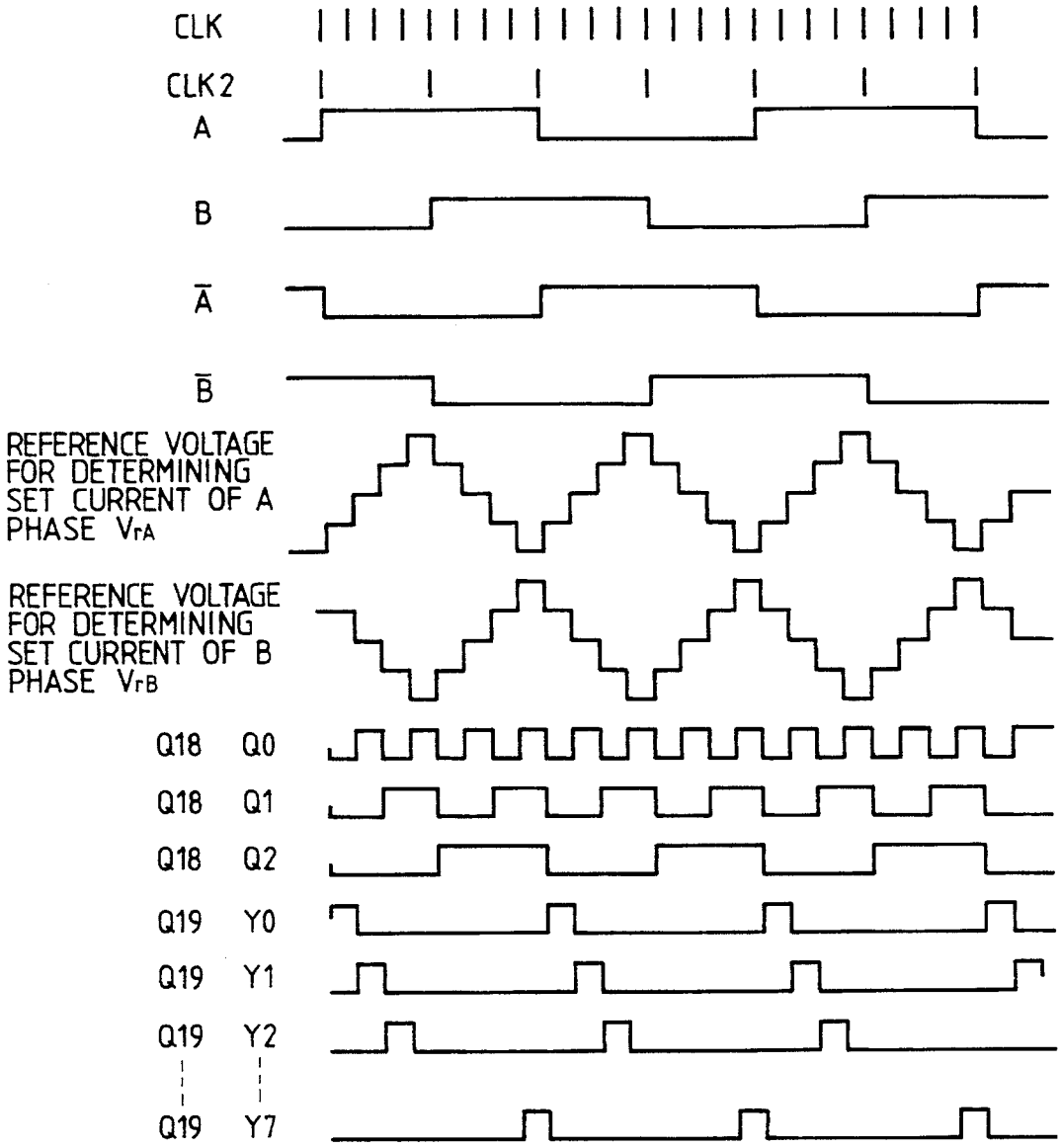
FIGS. 10 and 11 are timing charts for explaining a micro-step driving processing operation for each excitation method of a pulse motor 26 shown in FIG. 9.
Figure 11:
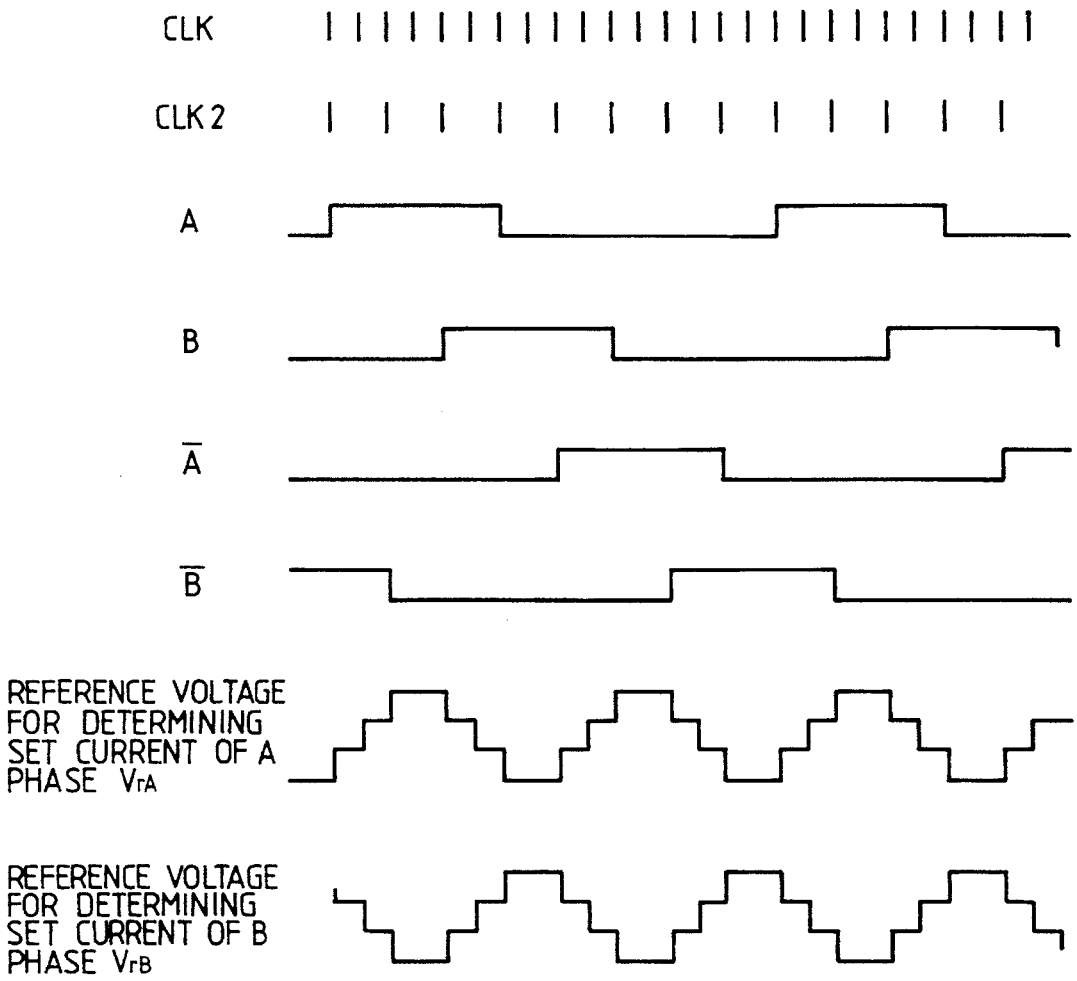

FIGS. 10 and 11 are timing charts for explaining the micro-step driving processing operations corresponding to excitation methods of the pulse motor 26 shown in FIG. 9. Note that FIG. 10 corresponds to a two-phase excitation method, and FIG. 11 corresponds to a one/two-phase excitation method.

[Reference Potential Setting Processing Upon Selection of Two-phase Excitation Method]

For a reference voltage VrA of the A phase, the counter Q18 is sequentially counted up in response to the clock CLK from the port PB4 of the microcomputer Q1. When count outputs Q0 to Q2 are at "L" level, the decoder Q19 sets an output Y0 at "H" level. Thus, the analog switch Q21 is activated, and a reference potential Vref0 is selected. Therefore, VrA=Vref0.

The counter Q18 is sequentially counted up in response to the clock CLK from the port PB4 of the microcomputer Q1, and the count outputs Q0 to Q2 are respectively set at "L" level, "L" level, and "H" level. The decoder Q19 sets an output Y1 at "H" level. Thus, the analog switch Q22 is activated (the analog switch Q21 is deactivated), thereby selecting a reference potential Vref1. Therefore, the reference voltage value VrA is set to be the reference potential Vref1. As described above, the reference voltage value VrA for the A phase of the pulse motor 26, which voltage determines a set current value is generated in accordance with the counter output values of the counter Q18.

A reference voltage for the B phase of the pulse motor 26 is similarly generated. In a two-phase excitation mode, since the A and B phases have a phase difference of 90°, a reference voltage value VrB for determining a set current of the B phase must have a phase difference of 90° from the voltage VrA. As inputs A, B, and C to be input to the decoder Q38, the counter output values Q0 and Q1, and an inverted value of Q2 are input.

[Reference Potential Setting Processing Upon Selection of One/Two-phase Excitation Method]

The microcomputer Q1 outputs the phase switching signals PB0 to PB3. In this case, an output terminal OUT1 of an extended IC Q2 outputs an "H"-level excitation switching signal to the selectors Q30 to Q37. Thus, each of the selectors Q30 to Q37 selects an input B of inputs A and B, thus selecting a current setting reference voltage Wref. At this time, the counter Q18 is sequentially counted up in response to the clock CLK from the port PB4 of the microcomputer Q1. When the counter output values Q0, Q1, and Q2 are respectively at "L" level, "L" level, and "L" level, the decoder Q38 selects an output Y3. Thus, the analog switch Q42 is activated, and a current setting reference voltage Wref3 is selected. Therefore, the reference voltage value VrB is set to be the reference potential Wref3.

When the counter Q18 is counted up, and the counter output values Q2, Q1, and Q0 are respectively set at "L" level, "L" level, and "H" level, the inputs C, B, and A of the decoder Q38 respectively go to "H" level, "L" level, and "H" level. An output Y4 of the decoder Q38 goes to "H" level, and the analog switch Q43 is activated, thus selecting a current setting reference voltage Wref4. Therefore, the reference voltage value VrB is set to be the reference potential Wref4. In this manner, the reference voltage value VrB for determining a set current value is generated in accordance with the counter output values of the counter Q18.

The driving processing operations of the pulse motor 26 in the image forming apparatus of this embodiment will be described below with reference to FIGS. 12 and 13.

Figure 12:
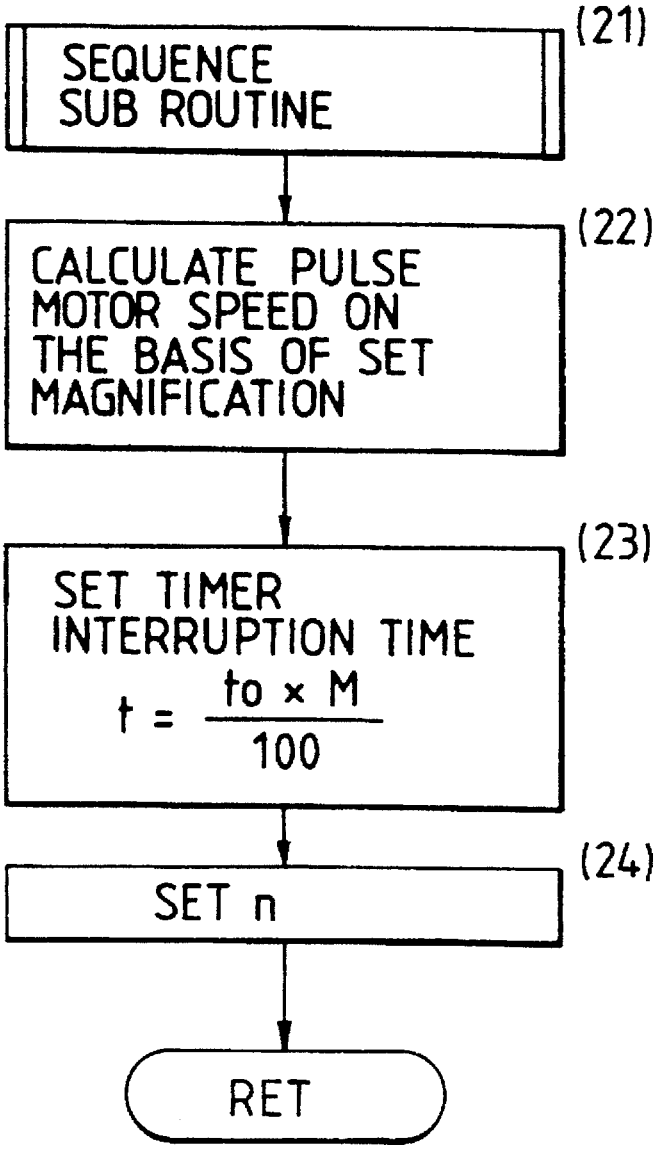
FIG. 12 is a flow chart for explaining an interruption time setting processing sequence in the image forming apparatus according to the present invention.

FIG. 12 is a flow chart for explaining an interruption time setting processing sequence in the image forming apparatus of this embodiment. Note that (21) to (24) in the chart designate steps.

When a copying magnification M is determined at an operation panel 50 shown in FIG. 2, a sequence sub routine of the main program is executed (step (21)) to calculate a set speed of the pulse motor 26 in the sequence sub routine (step (22)), and a timer interruption time t is calculated based on the following equation (3) below (step (23)). Then, a count setting value n is set (step (24)), thus ending processing. Note that the count setting value n is set to be "2" in the one/two-phase excitation mode, and is set to be "4" in the two-phase excitation mode.

$$t = \frac{t_0 \times \text{Magnification } M}{100} \tag{3}$$

Figure 13:
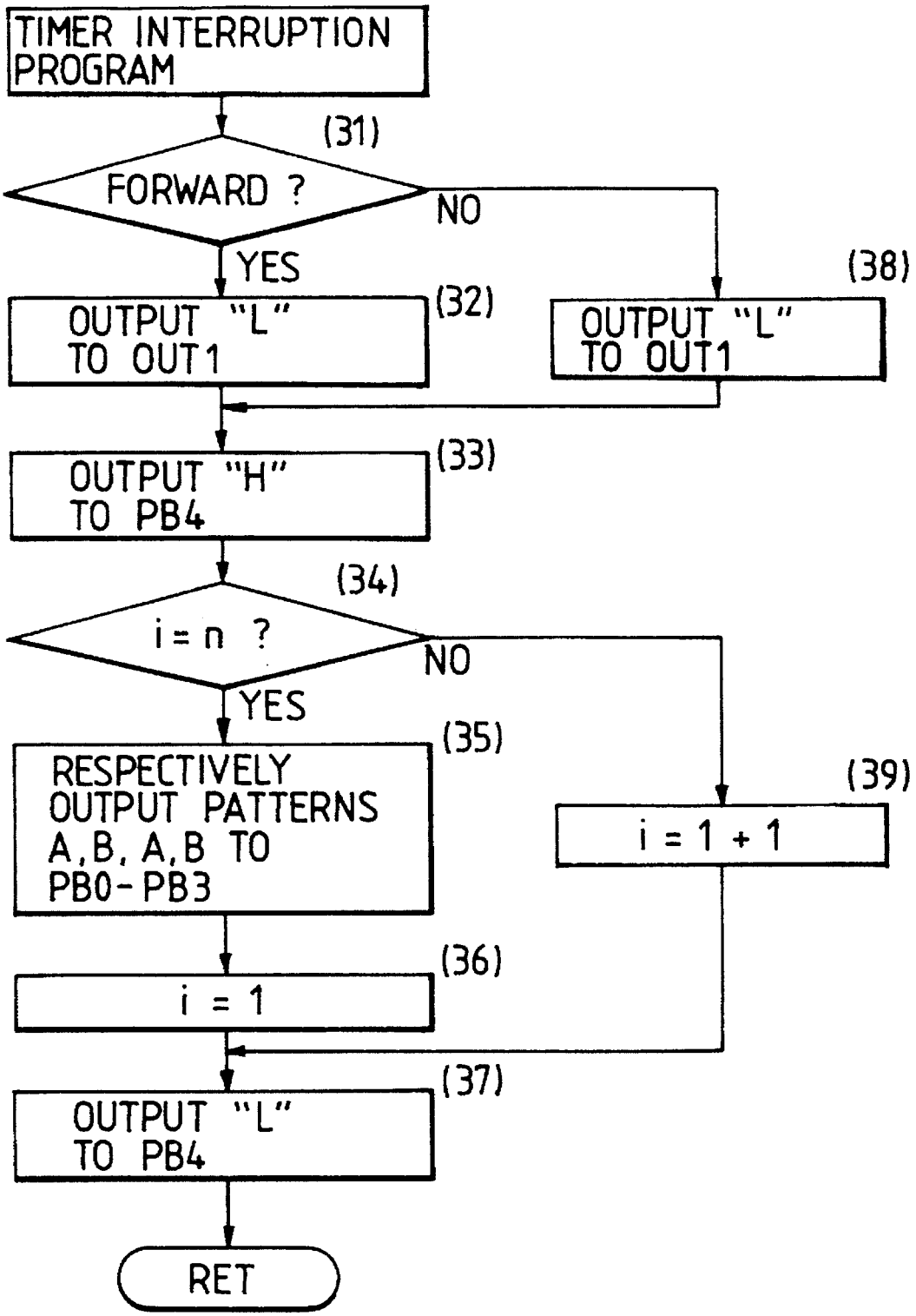
FIG. 13 is a flow chart for explaining a timer interruption processing sequence in the image forming apparatus according to the present invention.

FIG. 13 is a flow chart for explaining a timer interruption processing sequence in the image forming apparatus of this embodiment. Note that (31) to (39) in the chart designate steps.

When the timer interruption time t set in step (23) in the above-mentioned flow chart is reached, the timer interruption program is started. It is checked if a driving direction of an optical load is "forward" (step (31)). If YES in step (31), the output from the output terminal OUT1 of the extended IC Q2 is set at "L" level (step (32)). This is to select a current setting reference voltage Vref as a reference voltage for determining a set current for attaining one/two-phase excitation.

An "H"-level output is output from the port PB4 of the microcomputer Q1 (step (33)). it is then checked if a count value i coincides with the count value n (step (34)). If NO in step (34), the count value i is incremented by "1" (step (39)), and the flow advances to step (37).

On the other hand, if YES in step (34), the microcomputer Q1 outputs the phase switching signals PB0 to PB3 to the A and B phases of the pulse motor 26 (step (35)), thereby driving the pulse motor 26.

The count value i is reset to "1" (step (36)), and an "L"-level output is output from the port PB4 of the microcomputer Q1 (step (37)). Thus, the control returns to the main routine from the timer interruption routine.

If NO (backward) in step (31), the output from the output terminal OUT1 of the extended IC Q2 is set at "H" (step (38)) level to perform two-phase excitation. In the two-phase excitation mode, the count setting value n is set to be "4", and a reference voltage Wref is selected as a reference voltage for determining a set current.

In this embodiment, since a backward moving speed of a load is higher than a forward moving speed, the pulse motor 26 requires a larger torque. Therefore, when a load is moved backward, the set current is increased to obtain a larger torque. More specifically, a relation Vref<Wref is satisfied. It is then checked in step (34) if the count value i is equal to the count setting value n (=4). If the count value i=n, the microcomputer Q1 outputs the phase switching signals PB0 to PB3 to the A and B phases of the pulse motor 26 (step (35)), and the count value i is reset to "1". Furthermore, if i≠n, step (39) is executed, so that an "L"-level output is output from the port PB4 of the microcomputer Q1. Thus, the flow returns to the main routine from the timer interruption routine. In the one/two-phase excitation mode, the micro-step resolution is set to be coarser than that in the two-phase excitation mode.

Every time a timer interruption occurs, the port PB4 of the microcomputer Q1 is set at "H" or "L" level, and the clock CLK is generated. The clock CLK is input to a clock input terminal of the 3-bit counter Q18. Outputs Q0 to Q2 of the 3-bit counter Q18 are input to the decoder Q19 at timings shown in FIG. 10. Furthermore, the decoder Q19 outputs decoder outputs $Y_0$ to $Y_7$ at timings shown in FIG. 10.

The outputs $Y_0$ to $Y_7$ from the decoder Q19 are respectively supplied to the analog switches Q21 to Q28. At a timing shown in FIG. 10, i.e., when the decoder output $Y_0$ is at "H" level, the analog switch Q21 is activated. On the other hand, when the output from the output terminal OUT1 of the extended IC Q2 is at "L" level, the micro-step driving mode is selected. Thus, a reference potential Vref0 is applied to the inverting input terminals of the comparators Q16 and Q17, thereby selecting one micro-step constant current value $I_0$. Note that the constant current value $I_n$ is calculated by the following equation (4):

$$I_n = \frac{Vrefn}{Rsm} \tag{4}$$

In this embodiment, n is a value between 0 to 7, and m is 1 or 2.

When a timer interruption is started, the clock CLK is generated, and the count value of the 3-bit counter Q18 is incremented by one. The decoder Q19 selects the next decoder output $Y_1$ to set a set current $I_1$ (Vref1/Rsm). The same processing is repeated, and a current waveform shown in FIG. 10 is obtained. Note that this waveform is preferably closer to a sine wave as much as possible.

The preferred embodiments of the present invention have been described. However, the present invention is not limited to the arrangements of the embodiments, and various changes and modifications may be made within the scope of claims.

What is claimed is:

1. An image forming apparatus comprising:

a load for scanning an original image;

a pulse motor for driving said load, said load being moved forward from a home position to scan the original image and being moved backward to the home position;

excitation means for exciting said pulse motor, said pulse motor being excited in a one/two-phase excitation method when said load is moved forward and being excited in a two-phase excitation method when said load is moved backward;

supplying means for supplying a simulated sine waveform driving signal to said pulse motor, the simulated sine waveform driving signal being formed by stepwisely increasing and then decreasing a magnitude of a driving signal; and switching means for switching the number of steps per period of the simulated sine waveform driving signal for stepwisely increasing and then decreasing the magnitude of the driving signal in accordance with the excitation method of said pulse motor.

2. An apparatus according to claim 1, further comprising changing means for changing a magnitude of each step of the simulated sine waveform driving signal in accordance with the excitation method of said pulse motor.

3. An apparatus according to claim 1, further comprising forming means for forming a latent image according to the original image scanned by said load.

4. An apparatus according to claim 1, wherein said supplying means supplies the simulated sine waveform driving signal with a period corresponding to the excitation method of said pulse motor.

5. An apparatus according to claim 1, wherein said supplying means supplies the simulated sine waveform driving signal to said pulse motor at a predetermined interval.

6. An apparatus according to claim 1, wherein said pulse motor comprises at least one phase, and wherein said supplying means supplies the simulated sine waveform driving signal to each phase of said pulse motor at a predetermined pattern.

7. An image forming apparatus comprising:

a load for scanning an original image;

a pulse motor for driving said load, said load being moved at a speed corresponding to an image forming magnification;

excitation means for exciting said pulse motor, said pulse motor being excited with a period corresponding to the image forming magnification;

supplying means for supplying a simulated sine waveform driving signal to said pulse motor, the simulated sine waveform signal being formed by stepwisely increasing and then decreasing a magnitude of a driving signal; and switching means for switching the number of steps per period of the simulated sine waveform driving signal for stepwisely increasing and then decreasing the magnitude of the driving signal in accordance with the image forming magnification.

8. An apparatus according to claim 7, further comprising changing means for changing a magnitude of each step of the simulated sine waveform driving signal in accordance with the image forming magnification.

9. An apparatus according to claim 7, further comprising forming means for forming a latent image according to the original image scanned by said load.

10. An apparatus according to claim 7, wherein said supplying means supplies the simulated sine waveform driving signal to said pulse motor at a predetermined interval.

11. An apparatus according to claim 7, wherein said pulse motor comprises at least one phase, and wherein said supplying means supplies the simulated sine waveform driving signal to each phase of said pulse motor at a predetermined pattern.

12. An image forming method comprising the steps of:

scanning an original image using an image forming apparatus having a load for performing said scanning;

driving the load using a pulse motor, the load being moved forward from a home position to scan the original image and being moved backward to the home position;

exciting the pulse motor in a one/two-phase excitation method when the load is moved forward, and in a two-phase excitation method when the load is moved backward;

supplying a simulated sine waveform driving signal to the pulse motor, the simulated sine waveform driving signal being formed by stepwisely increasing and then decreasing a magnitude of a driving signal; and switching the number of steps per period of the simulated sine waveform driving signal for stepwisely increasing and then decreasing the magnitude of the driving signal in accordance with the excitation method of the pulse motor.

13. A method according to claim 12, further comprising a step of changing a magnitude of each step of the simulated sine waveform driving signal in accordance with the excitation method of the pulse motor.

14. A method according to claim 12, further comprising a step of forming a latent image according to the original image scanned by the load.

15. A method according to claim 12, wherein said supplying step supplies the simulated sine waveform driving signal with a period corresponding to the excitation method of the pulse motor.

16. A method according to claim 12, wherein said supplying step supplies the simulated sine waveform driving signal to the pulse motor at a predetermined interval.

17. A method according to claim 12, wherein said supplying step supplies the simulated sine waveform driving signal to each phase of the pulse motor, which has at least one phase, at a predetermined pattern.

18. An image forming method comprising the steps of:

scanning an original image using an image forming apparatus having a load for performing said scanning;

driving the load using a pulse motor, the load being moved at a speed corresponding to an image forming magnification;

exciting the pulse motor with a period corresponding to the image forming magnification;

supplying a simulated sine waveform driving signal to the pulse motor, the simulated sine waveform signal being formed by stepwisely increasing and then decreasing a magnitude of a driving signal; and switching the number of steps per period of the simulated sine waveform driving signal for stepwisely increasing and then decreasing the magnitude of the driving signal in accordance with the image forming magnification.

19. A method according to claim 18, further comprising a step of changing a magnitude of each step of the simulated sine waveform driving signal in accordance with the image forming magnification.

20. A method according to claim 18, further comprising a step of forming a latent image according to the original image scanned by the load.

21. A method according to claim 18, wherein said supplying step supplies the simulated sine waveform driving signal to the pulse motor at a predetermined interval.

22. A method according to claim 18, wherein said supplying step supplies the simulated sine waveform driving signal to each phase of said pulse motor, which has at least one phase, at a predetermined pattern.

* * * * *

UNITED STATES PATENT AND TRADEMARK OFFICE

CERTIFICATE OF CORRECTION

PATENT NO. : 5,583,620 Page 1 of 4

DATED : December 10, 1996

INVENTOR(S) : Kazuki MIYAMOTO

It is certified that error appears in the above-indentified patent and that said Letters Patent is hereby corrected as shown below:

ON THE TITLE PAGE:

Item [56], "FOREIGN PATENT DOCUMENTS":

"0218396" should read --01-218396--.

IN THE DISCLOSURE

COLUMN 2:

Line 9, "sub routine" should read --subroutine--;

Line 42, "26;" should read --26.--.

COLUMN 4:

Line 23, "depending of" should read --depending on--.

COLUMN 5:

Line 12, "sub routine" should read --subroutine--;

UNITED STATES PATENT AND TRADEMARK OFFICE

CERTIFICATE OF CORRECTION

PATENT NO. : 5,583,620 Page 2 of 4

DATED : December 10, 1996

INVENTOR(S) : Kazuki MIYAMOTO

It is certified that error appears in the above-indentified patent and that said Letters Patent is hereby corrected as shown below:

Line 14, "sub routine" should read --subroutine--;

Line 38, "Outputs" should read --outputs--.

COLUMN 7:

Line 15, "b." should read --B.--.

COLUMN 8:

Line 31, "feed-amount" should read --feed amount--.

COLUMN 11:

Line 2, "sub" should read --sub- --.

UNITED STATES PATENT AND TRADEMARK OFFICE

CERTIFICATE OF CORRECTION

PATENT NO. : 5,583,620 Page 3 of 4

DATED : December 10, 1996

INVENTOR(S) : Kazuki MIYAMOTO

It is certified that error appears in the above-indentified patent and that said Letters Patent is hereby corrected as shown below:

COLUMN 12:

Line 9, "80% a target speed," should read --an 80% target speed,--;
Line 10, "80% the target speed," should read --the 80% target speed,--.

COLUMN 14:

Line 9, "sub routine" should read --subroutine--;
Line 11, "sub routine" should read --subroutine--.

COLUMN 15:

Line 52, "stepwisely" should read --stepwise--;
Line 58, "stepwisely" should read --stepwise--.

COLUMN 16:

Line 24, "stepwisely" should read --stepwise--;
Line 30, "stepwisely" should read --stepwise--;

UNITED STATES PATENT AND TRADEMARK OFFICE

CERTIFICATE OF CORRECTION

PATENT NO. : 5,583,620 Page 4 of 4

DATED : December 10, 1996

INVENTOR(S) : Kazuki MIYAMOTO

It is certified that error appears in the above-indentified patent and that said Letters Patent is hereby corrected as shown below:

Line 62, "stepwisely" should read --stepwise--;
Line 66, "stepwisely" should read --stepwise--.

COLUMN 18:

Line 5, "stepwisely" should read --stepwise--;
Line 8, "stepwisely" should read --stepwise--.

Signed and Sealed this

Eighth Day of July, 1997

Bruce Lehman

*Attest:*

BRUCE LEHMAN

*Attesting Officer*

*Commissioner of Patents and Trademarks*